United States Patent [19]

Tajima et al.

[11] Patent Number: 5,026,180

[45] Date of Patent: Jun. 25, 1991

[54] THERMAL INK-TRANSFER PRINTER CAPABLE OF PREVENTING OFF-REGISTRATION OF COLORS AT COLOR PRINTING

[75] Inventors: Osamu Tajima, Moriya; Terumasa Kuramoto, Noda; Yoshitaka Suzuki, Moriya, all of Japan

[73] Assignee: Victor Company of Japan, Ltd., Yokohama, Japan

[21] Appl. No.: 288,211

[22] Filed: Dec. 22, 1988

[30] Foreign Application Priority Data

Dec. 22, 1987 [JP] Japan ..... 62-324367

[51] Int. Cl.[5] ..... B41J 2/325

[52] U.S. Cl. ..... 400/120; 101/409; 346/138

[58] Field of Search ..... 400/120, 120 MP; 101/232, 408, 409, 410, 411; 271/82, 277; 346/103, 125, 138, 76 PH

[56] References Cited

U.S. PATENT DOCUMENTS 3,918,707 11/1975 Villemer et al. ..... 271/277

FOREIGN PATENT DOCUMENTS 171662 9/1984 Japan ..... 400/120 MP
80074 4/1987 Japan ..... 400/120
222868 9/1987 Japan ..... 101/409
134269 6/1988 Japan ..... 101/409

*Primary Examiner*—David A. Wiecking
*Attorney, Agent, or Firm*—Fleit, Jacobson, Cohn, Price, Holman & Stern

[57] ABSTRACT

A thermal ink-transfer printer for printing a color image on a paper wound along a platen roller in the manner where a thermal head is pressed against the paper and an ink film interposed therebetween so that ink on the ink film is melted by the thermal head. The printer comprises clamp mechanisms having supporting rings and clamp levers for holding an end of the paper against a holding member, clutch mechanisms having clutch rings and clutch levers for fixing the clamp mechanisms and platen roller in a start positioning mode and a printing mode, and a controlling element for coupling the clutch mechanisms with the platen roller in a paper feeding mode and a paper ejecting mode. As the clamp mechanisms hold the supplied end of the paper and the platen roller and the clamp mechanisms have their rotation individually controlled, it is possible to prevent color off-registration in color printing.

7 Claims, 27 Drawing Sheets

FLOW CHART OF RESET MODE

FLOW CHART OF PAPER SUPPLY MODE

FLOW CHART OF PAPER EJECTING MODE

THERMAL INK-TRANSFER PRINTER CAPABLE OF PREVENTING OFF-REGISTRATION OF COLORS AT COLOR PRINTING

BACKGROUND OF THE INVENTION

The present invention relates to thermal ink-transfer printers and, particularly to thermal ink-transfer printers which are capable of printing on paper surfaces longer than the circumference of the outer surface of the platen roller without being limited by the circumference of the outer surface of the roller.

Conventional thermal ink-transfer printers roughly comprise, as shown in FIG. 1, a platen roller 1 which has printing paper 2 supplied to its outer surface and which winds the paper 2 around the outer surface by counterclockwise rotation, a clamper 3 for pressing the paper 2 against the outer surface of the roller 1, an ink film 4 which is moved in direction A of FIG. 1 in accordance with the rotation of the roller 1 and to which is applied a fusible or sublimational ink on a surface thereof, and a thermal head 5 which presses the ink film 4 against the paper 2 and transfers ink applied to the ink film 4, to the paper 2 by means of heat of a heating element 6, on the basis of signals supplied correspondingly with the rotation of the platen roller 1.

The conventional printer as mentioned above, in the case of printing a frame of color picture or character, uses ink film 4 having a color frame which comprises a plurality of primary color patterns such as yellow, deep blue (cyan blue), and magenta, as well as black to a corresponding one frame of a picture. Since the printing paper 2 is conveyed with the rotating platen roller 1 being positioned and held by the clamp 3 and since each line to be printed is printed progressively in accordance with the state of rotational phase of the platen roller 1, it is quite difficult to cause an accurate registration made sequentially by these color patterns provided on the ink film 4 for each frame of a picture.

However, conventional printers also have the following problems:

(a) The length of the printing paper 2 is restricted to within the outer surface length of the platen roller 1;

(b) The enlargement of the diameter of the platen roller 1, in order to make it possible to print large pictures, causes the picture quality to degrade due to an inherent decrease of the pressure of the heat element 6 attached to the thermal head 5. The larger the diameter of the platen roller 1, the broader the total contact area to the head assembly. As the pressure per unit area of the contact portion decreases, if pressure to the head assembly is fixed, this phenomenon reduces the relative pressure between the head elements arranged in a line-shape and both the ink film 4 and paper 2 on the platen roller 1, so that a satisfactory print cannot be obtained unless pressure force increases;

(c) The enlargement of the platen roller 1 requires an increase in the pressure of the thermal head 5 as described in the above item (b), and the consequent enlargement with increased rigidity which is needed to cause the printer to become heavy and bulky and to increase the manufacturing cost; and (d) The increase of the pressure of the thermal head 5 to match the enlargement of the roller 1 causes the driving mechanism of the roller 1 to become large, making it difficult to control the roller 1.

In order to eliminate some of the defects described in the above items (a) to (d), the alternative configuration shown in FIG. 2 is conventionally provided as another example of FIG. 1. The printer in FIG. 2 roughly comprises a platen roller 1 for winding a printing paper 2A longer than the length of the circumference of the outer surface of the roller, a pinch roller 7 for pinching the paper 2A between the roller 1 in order to transport the paper 2A by-directionally. Other elements with the same numbers as FIG. 1 are either identical or equivalent. The printer shown in this example is capable of continuously printing on paper 2A which is longer than the length of the circumference of the outer surface of the roller 1. The roller 1 makes a clockwise rotation to bring the paper 2A back to a starting position after each printing pass. The thermal head 5 presses the ink film 4 to the paper 2A during a feed of the paper 2A together with the ink film 4 for each printing pass paper 2. Printing to the paper 2A is performed by repeating this process for each color pattern.

Though the defects in the items (a) to (d) are eliminated by means of the printer shown in FIG. 2, there is the following further problem.

In the case of printing a color picture to the paper 2A, the paper 2A has to be returned to the starting position of printing whenever each color pattern of the color frame is printed. While the paper 2A advances and returns, the paper 2A is apt to displace with respect to the platen roller 1, therefore it is a problem of off-registration in the colors printed on the paper 2A. Accordingly, this type of conventional printer is unsuitable for printing color pictures of high definition image.

SUMMARY OF THE INVENTION

The present invention is provided to overcome the above-mentioned defects of the conventional printers. An object of the invention is to provide a printer capable of preventing the occurrence of off-registrations in colors when printing an image or characters of a plurality of colors on paper, by means of clamping the supplied end of the paper to prevent the starting position from being displaced during the reciprocating motion of the printing paper.

To achieve the above object, the thermal ink-transfer printer of this invention, which has a platen roller with the supplied paper positioned on its surface and a pinch roller pressing the paper against the platen roller, and printing color picture on the long paper continuously supplied by pressing an ink film fed with the paper against the platen roller, comprises a clamp mechanism which is rotatably arranged at both ends of the platen roller and rotates with the platen roller while clamping the supplied end of the long paper during printing, a clutch mechanism for coupling the clamp mechanism with the platen roller, and a control mechanism for controlling decoupling the clutch mechanism from the platen roller when the clamp mechanism rotates through a predetermined angle before coming into contact with a thermal head.

As this invention has the above-mentioned construction, the control mechanism controls to release the clutch mechanism which coupled the platen roller when the clamp mechanism clamping the supplied end of the paper at the start of printing rotates with the platen roller through a predetermined angle, so that the paper therefore passes between the platen roller and the pinch roller with the supplied end of the paper to the rollers being maintained in a fixed state. As the printing is performed in such a manner, even in the case when a size of color pictures to be printed on the paper is longer than the circumference of the outer surface of the platen roller, variously colored inks are printed on the paper without there being any displacement between colors.

DESCRIPTION OF THE PREFERRED EMBODIMENTS

Preferred embodiments of a thermal ink-transfer printer of the present invention will be described in detail hereinunder with reference to the accompanying drawings.

FIGS. 3 through 9 show one embodiment of the printer of this invention.

Figure 1:
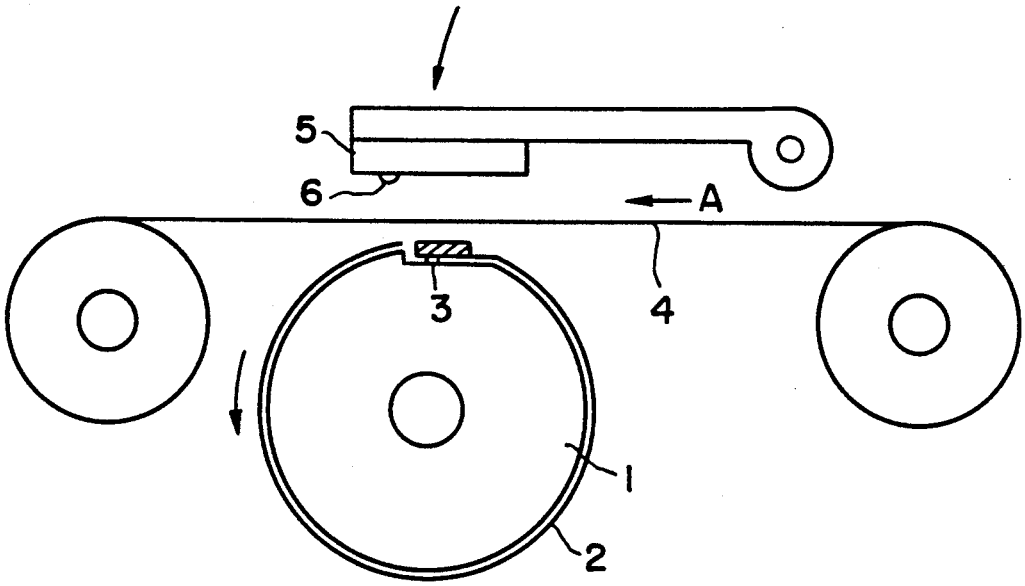
FIG. 1 PRIOR ART
FIG. 1 is a schematic constituent illustration showing one embodiment of the conventional thermal ink-transfer printer.
Figure 2:
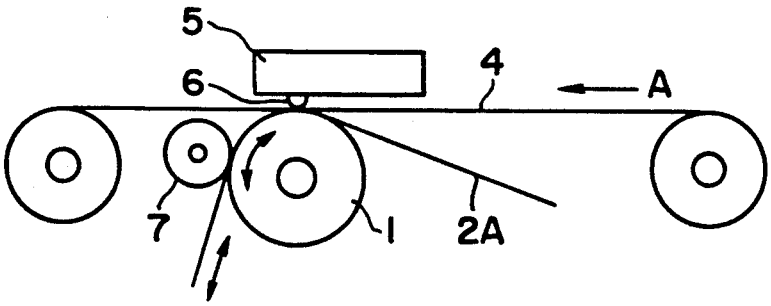
FIG. 2 PRIOR ART
FIG. 2 is a schematic constituent illustration showing another embodiment of the conventional thermal ink-transfer printer.
Figure 3:
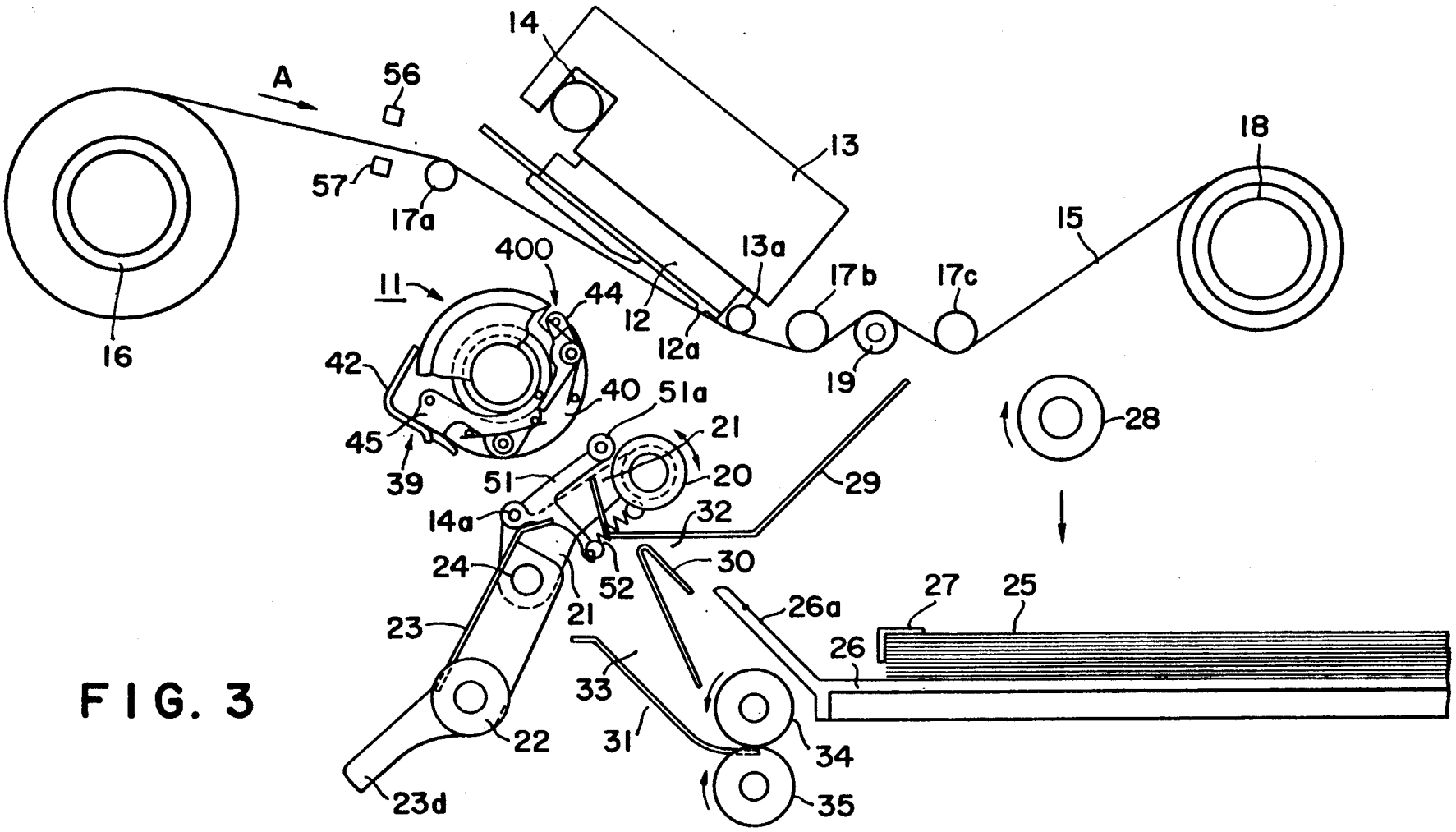
FIG. 3 is a schematic constituent illustration showing one embodiment of a thermal ink-transfer printer of the present invention.

FIG. 3 is a schematic diagram showing the printer of this embodiment comprising a platen roller 11, a thermal head 12, a supply reel 16 for continuously supplying an ink film 15, a winding reel 18 for taking in the ink film 15, a pinch roller 20 for pressing down the printing paper 25 against the platen roller 11, and a paper feed roller 28 for supplying the printing paper 25 placed on a paper tray 26.

The thermal head 12 is held by a holding member 13 placed above the platen roller 11. The holding member 13 is rotatably supported to a primary body of the printer. The member 13, as described hereinunder, as driven to rotate clockwise by an actuator not shown in the figure, so that the thermal head rotates down to the position of pressing down on the platen roller 11.

The ink film 15 has a plurality of color frames sequentially arranged in four color patterns such as yellow, cyan-blue, magenta and black. The film 15 is stretched between the platen roller 11 and the thermal head 12. One end of the film 15 is fed out by the supply reel 16 and the other end is wound up by the winding reel 18. The film 15 is guided by guide rods **17*a* to 17*c* which are suitably arranged between reels 16 and 18, and by a roller 13*a* attached to the support member 13. Furthermore, the film 15 is given a predetermined tension by a tension rod 19 arranged between guide rods 17*b* and 17*c*, therefore the slackening of the film 15 between reels 16 and 18** is prevented.

A reflection type optical sensor 56 and a reflecting plate 57 opposite to the sensor 56 are provided respectively at both sides of the film 15 and between the guide roller **17*a* and the supply reel 16. The optical sensor 56 detects numbers of transparent portions and opaque portions arranged at both edges of the upper surface of the film 15 as markers. The transparent and opaque portions are not shown in the figures. Since the film 15 has color frames sequentially arranged in four color patterns such as yellow, cyan-blue, magenta and black, as described above, the optical sensor 56** detects the number of transparent and opaque portions corresponding to each color and outputs color detection signals.

The pinch roller 20 is rotatably supported at a top end of a lever 21 which is rotatably supported on a shaft 24 as the rotational center. A guide arm 23 is rotatably supported by the same shaft 24 commonly with the lever 21, and the lower end of the guide arm 23 is supported by a guide roller 22.

The printing paper 25 is stacked in the paper tray 26 having a slant face **26*a* for feeding the paper 25. The stack of paper 25 is held at the supply end of the paper by a holding finger 27 having an "L" shape in cross section. A paper feeding roller 28 is arranged above the stacked paper 25 and the tray 26, which goes down and is driven to rotate when the paper 25 is supplied to the platen roller 11, so that the paper 25 on the tray 26 is fed leftward as shown in FIG. 3. Guide plates 29, 30 and 31 are arranged between the pinch roller 20 and the tray 26. The guide plates 29 and 30 form a paper feeding path 32 and the guide plates 30 and 31 form a paper ejection path 33**.

Paper ejection rollers 34 and 35 are provided under the tray 26 and the guide plate 31, and since roller 34 rotates counterclockwise and roller 35 clockwise, the paper 25 is therefore conveyed through the paper ejection path 33 after printing, and discharged out of the printer.

Referring to FIGS. 4 to 9, the peripheral construction of the platen roller 11 will be described hereinunder in detail.

Figure 4:
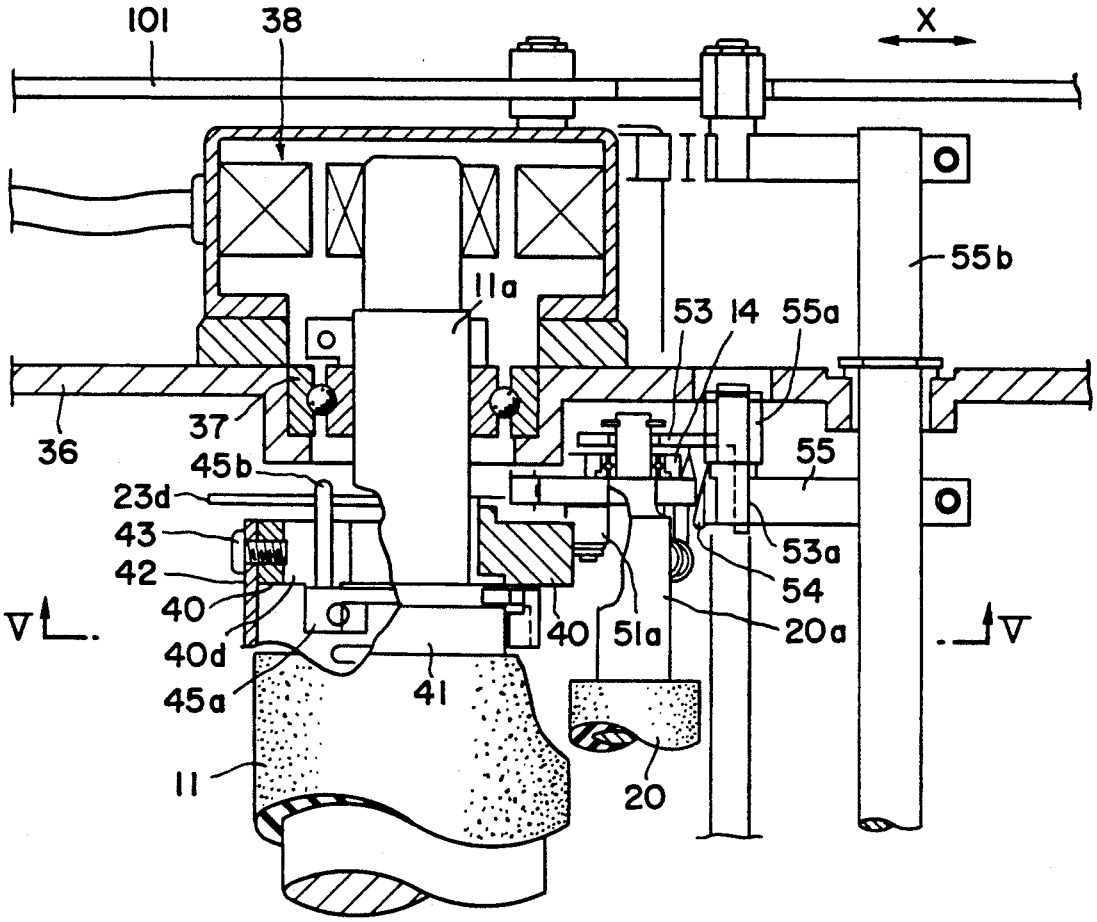
FIG. 4 is a transverse cross section showing one end of the platen roller of the embodiment shown in FIG. 3.

As shown in FIG. 4, the platen roller 11 has flexible body formed by rubber around its outer surface. A shaft **11*a* projects from both ends of the roller 11 in order to be mounted on a side wall 36 of the printer by means so that the shaft 11*a* is supported by a bearing 37. One end of the shaft 11a has an encoder 38 which detects the rotation of the roller 11**.

The encoder 38 outputs one reference pulse PG(Z) (PG—Pulse Generator) which gives the standard position of rotation while roller 11 makes one revolution, and outputs 1500 consecutive pulses FG (Frequency Generator) which indicate the rotational positions (phase) of the platen roller 11.

Figure 6:
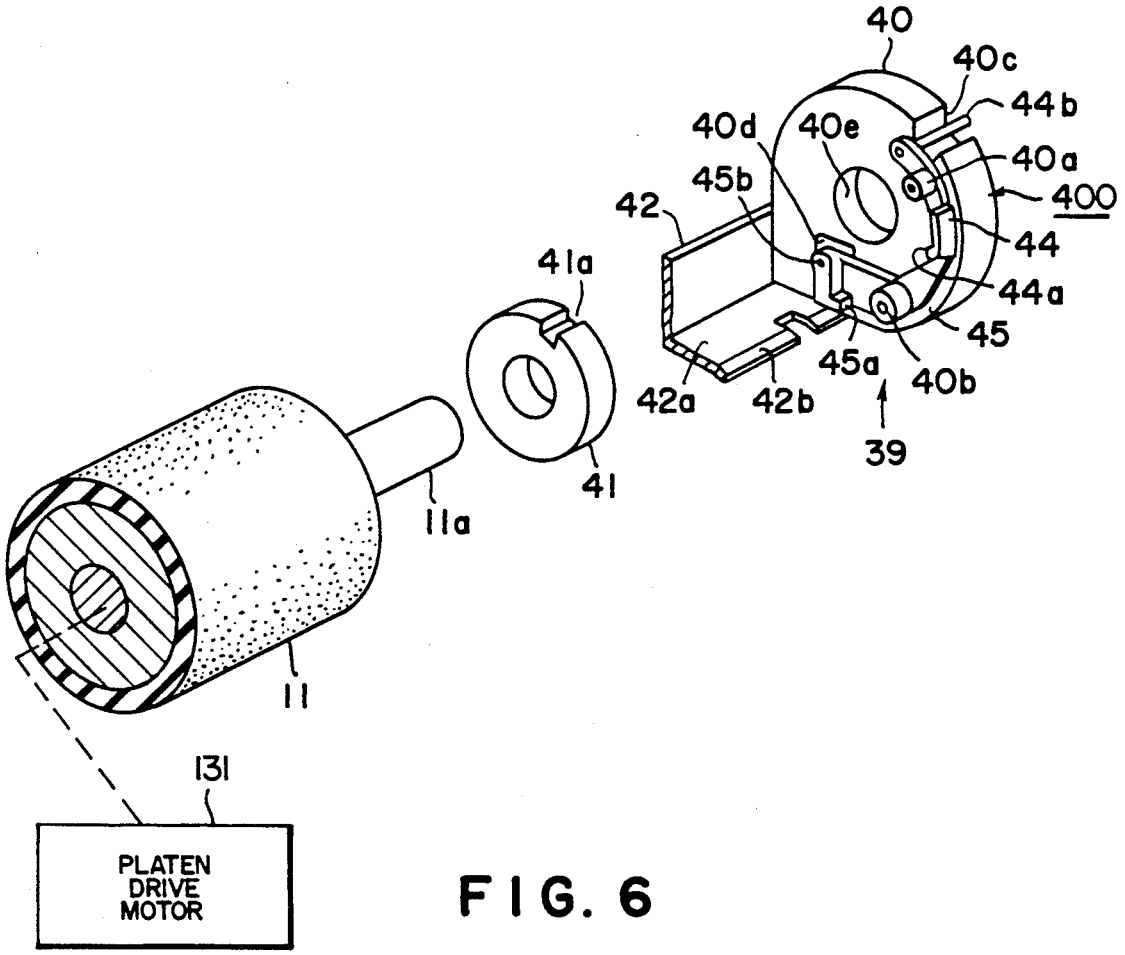

The other end of shaft 11a, not shown in the figures, has a driving mechanism such as the motor 131 shown schematically in FIG. 6 for the platen roller.

In FIG. 4, a cam plate 101 is arranged parallel to and outside of the wall 36. The movement of the cam plate 101 in the direction of the arrow X by the driving motor, causes the lever 21 and the guide arm 23 supporting the pinch roller 20 and guide roller 22 to rotate and move into position. The moved position of the cam plate 101 is detected by three cam sensors constructed by optical sensors that output detection signals supplied to the driving motor to control a rotational angle of the motor.

The cam plate 101 will be described in detail by using FIG. 24. The cam plate 101 is supported and movable in the directions of the arrow X by a plurality of rollers 100, . . . which are arranged to a frame (not shown in FIG. 24) of the printer.

The cam plate 101 is formed such that there are at predetermined positions, a guide roller controlling cam 101a, a pinch roller controlling cam 101b, and a thermal head controlling cam 101c which cause respectively the guide roller 23, the pinch roller 20, and the thermal head 12 to contact and detach the platen roller 11. The cam plate 101 has a supply reel control cam 101d and a winding reel control cam 101e which control respectively the supply reel 16 and the winding reel 18 at the desired drive timings. Rollers 102a to 102e in contact with control cams 101a to 101e, respectively, are displaced in the X and Y directions in correspondence with the movement of the cam plate 101 in the direction X to the respective stop positions, so that the guide roller 23, pinch roller 20 and so on are placed into or out of contact with the platen roller 11, and so that the supply reel 16 and the winding reel 18 are suitably driven by the movement of these rollers 102a to 102e.

Figure 24:
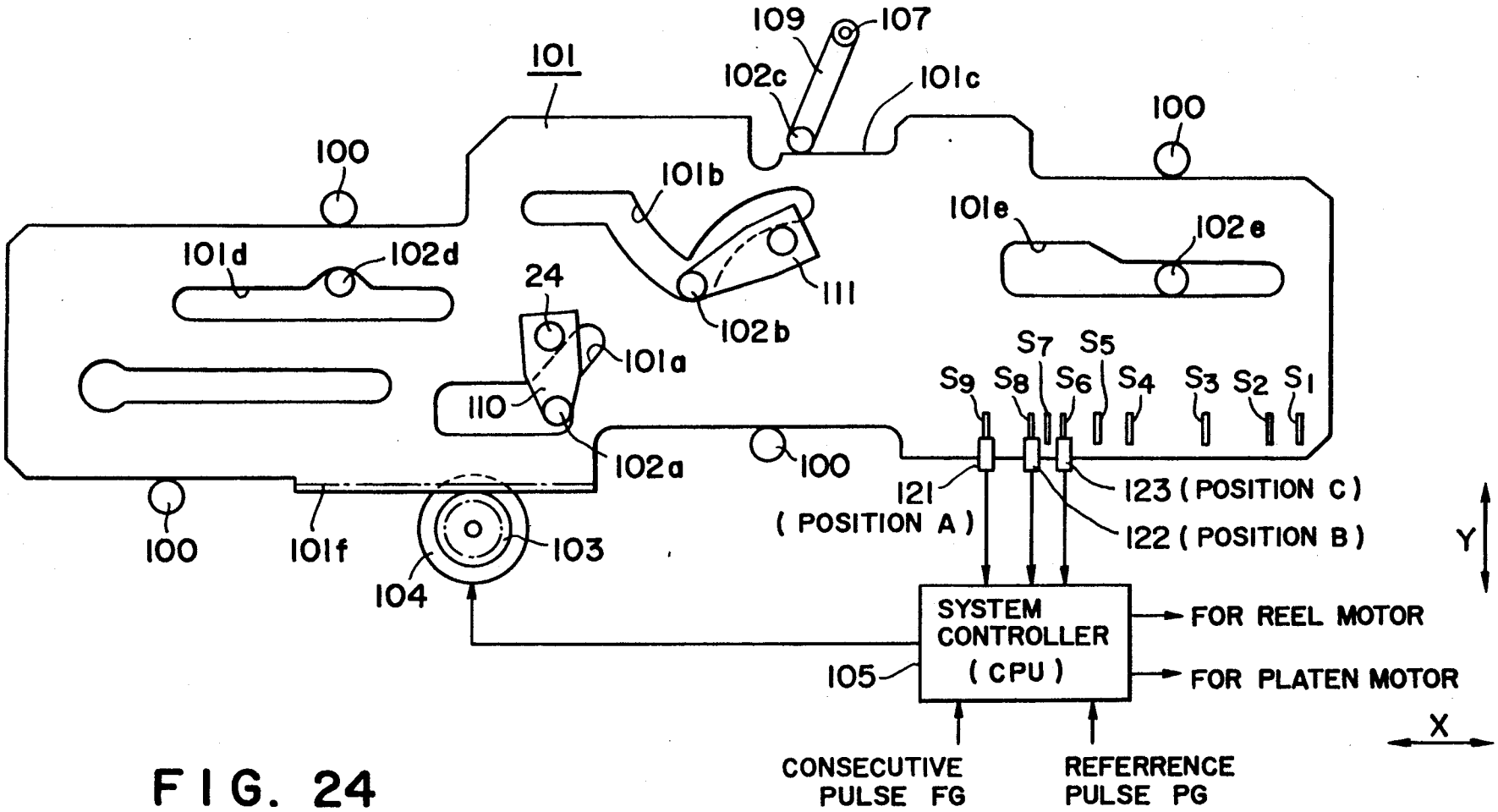
FIG. 24 is a schematic front view showing a driving mechanism and a position detecting mechanism for various rollers used in the printer of this invention.

The cam plate 101, at the bottom middle of FIG. 24, has a rack 101f which engages with a pinion 103 driven by a motor 104 for driving the cam plate in the direction and amount of rotation. By the rotation of the motor 104, the cam plate 101 is moved in the directions of arrow X.

Furthermore, the cam plate 101, at the bottom of FIG. 24, has nine slits $S_1$ to $S_9$ which are placed at predetermined intervals along a line in the direction of motion (indicated by the arrow X) of the cam plate 101.

The slits $S_1$ to $S_9$, shown in FIG. 24, are detected by three monolithic and light interrupting sensors 121, 122 and 123 arranged at positions A to C at predetermined intervals. Namely, each sensor 121, 122 or 123 has an emitting portion and a receiving portion which are arranged facing each other across the slitted portion of the cam plate 101. The light emitted from the emitting portion reaches the receiving portion through any of the slits $S_1$ to $S_9$ and the results of detection are outputted.

The detection output from the sensors 121, 122 and 123, shown in FIG. 24, are supplied to a system controller 105, using a central processing unit (CPU) and so on, which causes the cam plate 101 to move by supplying drive signals to the motor 104 in accordance with the operational mode of the thermal printer, and controls the pinch roller 20 and the guide roller 23 to move into and out of contact with the platen roller 11 and the supply reel 16 and the winding reel 18 to their respective positions correspondingly with the movement of the cam plate 101 to the positions according to a predetermined mode number on the basis of the combination of detection results out from the sensors 121, 122 and 123.

The system controller 105 is supplied with the PG pulse and the FG pulse corresponding to the amount of revolution of the platen roller 11. The controller 105 controls the platen motor and the reel motor for rotating the platen roller 11 and the supply reel 16 and so on so that they rotate properly at the predetermined timing for each mode, by supplying drive signals on the basis of the PG and FG pulses.

The platen roller 11 has on both its ends a pair of rings 40, each having clamp mechanism 39. The rings 40 are rotatably mounted to both ends of the roller shaft 11a. As the rings 40 on both sides have the same construction, the ring 40 of one side will be described in detail by referring to FIGS. 4 to 6.

A clutch ring 41 with a recess 41a on its outer surface is fixed securely to the shaft 11a. The ring 40 is located at the outside of the clutch ring 41. A holding member 42, "L"-shaped in cross section and elongated along the platen roller 11, is engaged to the rings 40 by screws 43. The holding member 42, as described hereinunder, has a planar clamp portion 42a for holding the printing paper 25, and a folded end portion 42b which is formed by bending the edge of the clamp portion 42a in order to facilitate insertion of the printing paper 25.

Shafts 40a and 40b project from the internal surface of the ring 40 for supporting a clutch lever 44 and a clamp lever 45, and a recess 40c is formed on the external surface of the ring 40. Furthermore, the ring 40 has a rectangular through hole 40d and a center hole 40e into which the end of the shaft 11a is inserted.

The clutch lever 44 has a projection 44a at one end for engaging the recess 41a of the clutch ring 41 and composes a clutch mechanism 400 with the clutch ring 41. At the other end, the clutch lever 44 has a pin 44b which is inserted in the recess 40c of the ring 40, and a hole 44c into which the shaft 40a of the ring 40 is inserted. The hole 44c is made at the center of the lever 44. The clutch lever 44 is biased to clockwise rotation, as shown in FIG. 5, by means of the elastic force of a torsion spring 46 which is rotatably supported by the shaft 40a.

The clamp lever 45 has a clamp portion 45a for contacting the clamp portion 42a of the holding member 42, a pin 45b which goes into the through hole 40d of the ring 40, and a hole 45c into which the shaft 40b of the ring 40 is inserted. The clamp lever 45 is rotatably supported by the shaft 40b and is biased to counterclockwise rotation, as shown in FIG. 5, by means of the elastic force of a torsion spring 47.

Figure 5:
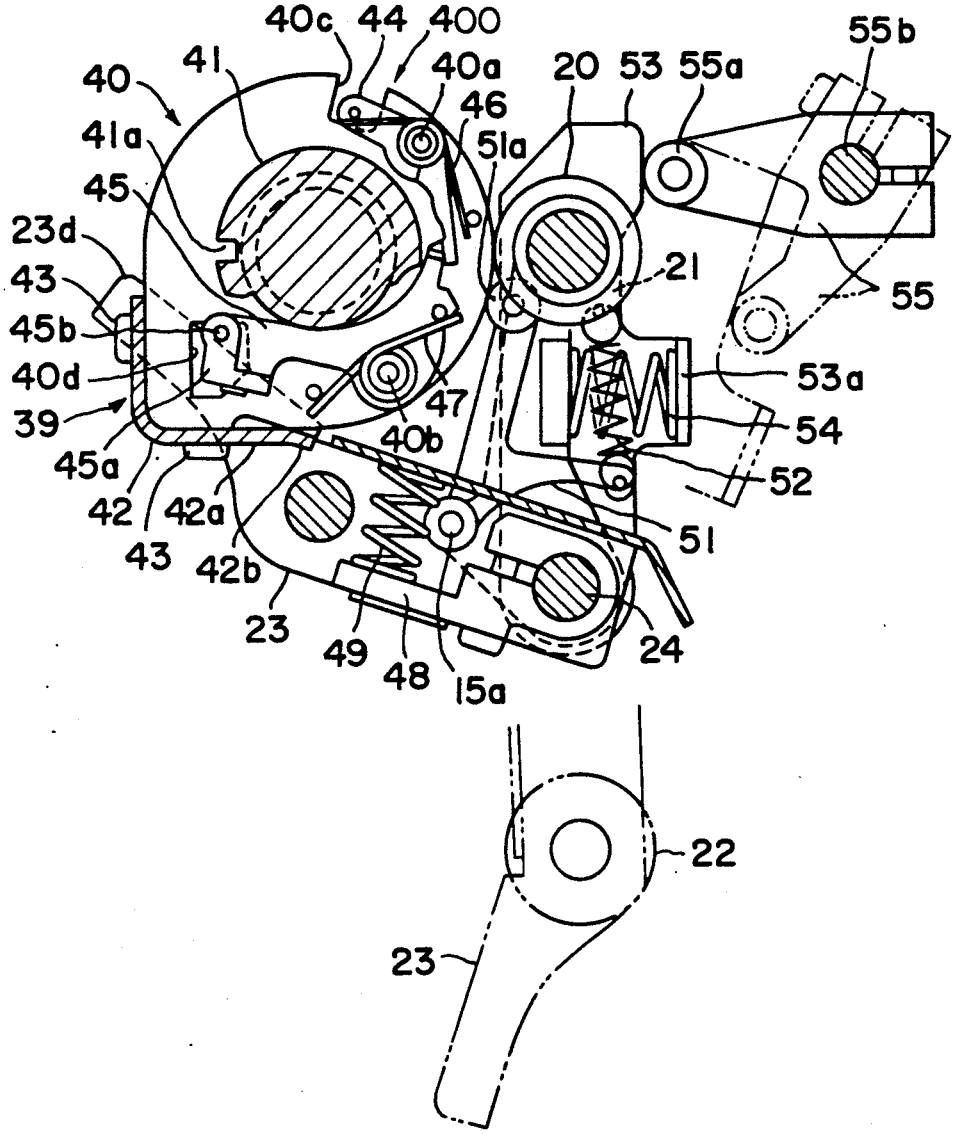
FIGS. 5 through 7 are a longitudinal section, a perspective view and an exploded perspective view, respectively, illustrating a main part of the printer shown in FIG. 3.
Figure 7:
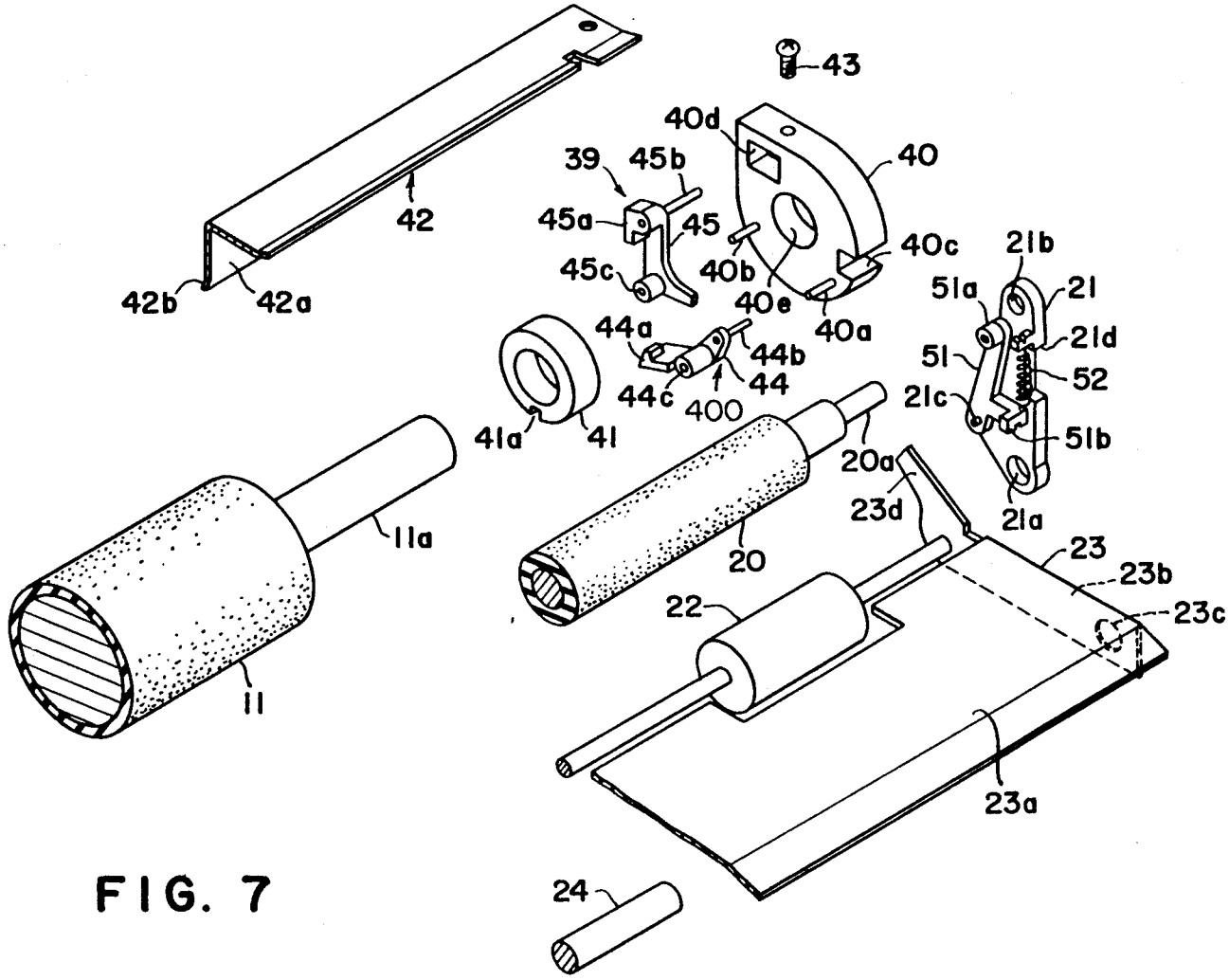
Figure 9:
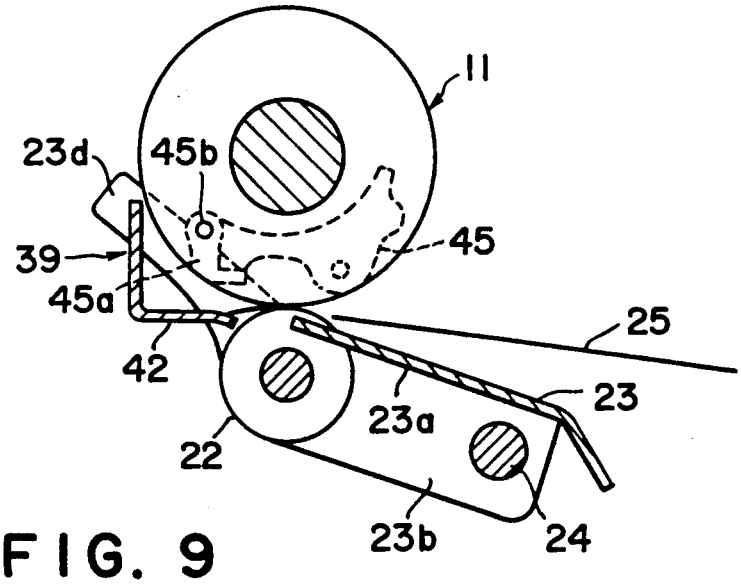
FIG. 9 is a sectional view showing the state where the clamp mechanism releases a snap of the paper.
Figure 11:
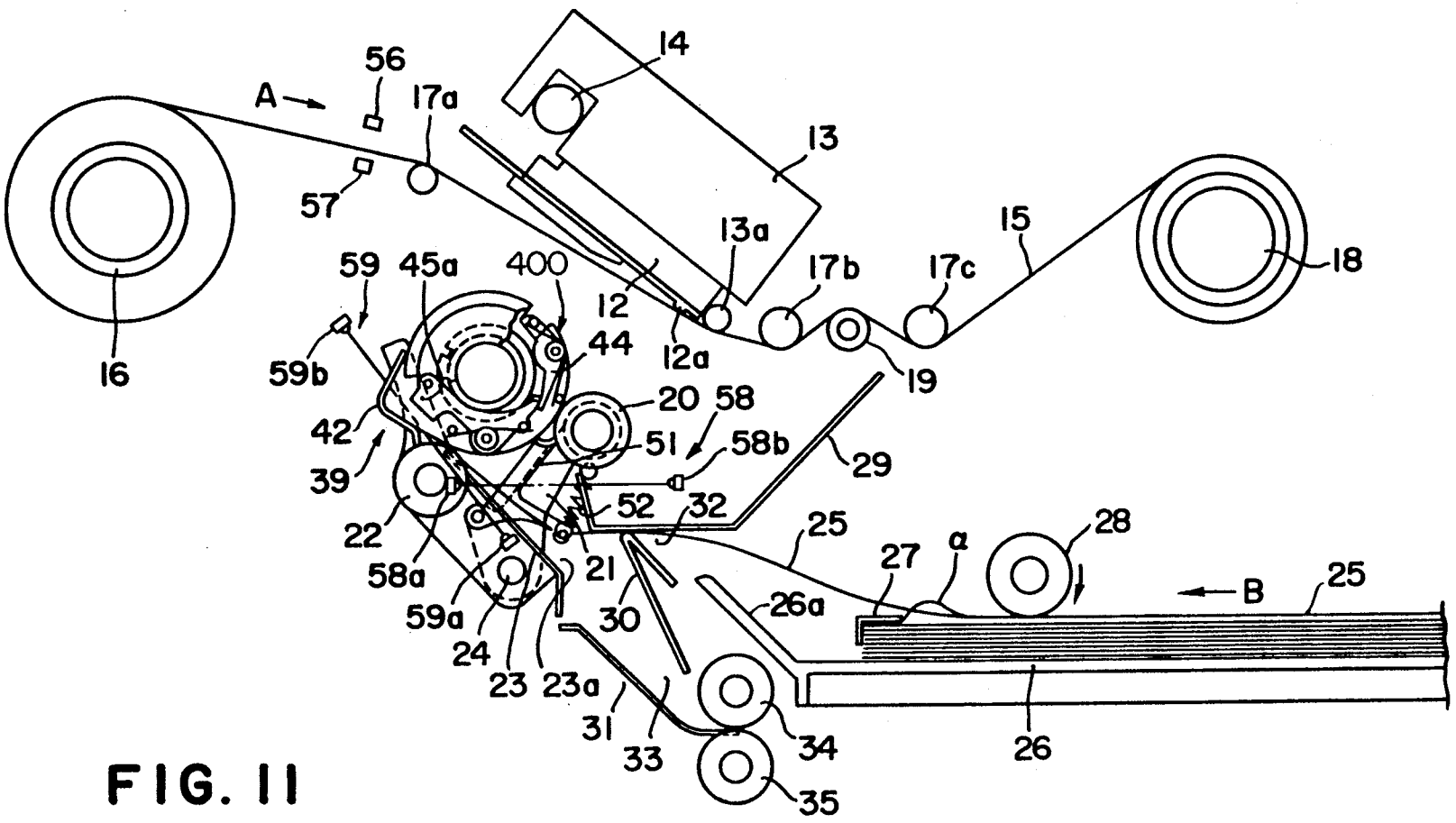
FIGS. 11 through 14 are front views, showing the movement of the printer in the paper feed mode.

The guide arm 23 comprises, as shown in FIGS. 5 to 7, a plate portion 23a for guiding the printing paper 25, and side plate portions 23b which are bent down from both ends of the plate portion 23a and which support the guide roller 22. The guide arm 23 has, as described hereinunder, the first paper sensor 58 and the second paper sensor 59 which comprise emission elements 58a and 59a, and receiving elements 58b and 59b as shown in FIG. 11. The front edge portion of the plate portion 23a is bent downward in order to facilitate feeding the printing paper 25. The side plate portions 23*b* have holes 23*c* at the front ends into which the shaft 24 is inserted, and extended portions 23*d* which incline away from the rear end of both side plate portions 23*b*. An arm 48, as shown in FIG. 5, is fixed to the shaft 24, and a coil spring 49 is arranged between the arm 48 and the plate portion 23*a* of the guide arm 23. Accordingly, as shown in FIG. 9, as the axis 24 rotates in the clockwise direction at the paper supply mode, the guide arm 23 is urged by rotation of the arm 48 via the elastic force of the spring 49. Therefore, the guide arm 23 rotates in the clockwise direction from the position shown by the double-dotted line in FIG. 5, and the extended portion 23*d* touches a pin 45*b* of the clamp lever 45 which is projected from the through hole 40*d* of the ring 40. By this motion, as the clamp lever 45 rotates in the clockwise direction, the clamp portion 45*a* detaches from the clamp portion 42*a*.

Figure 8:
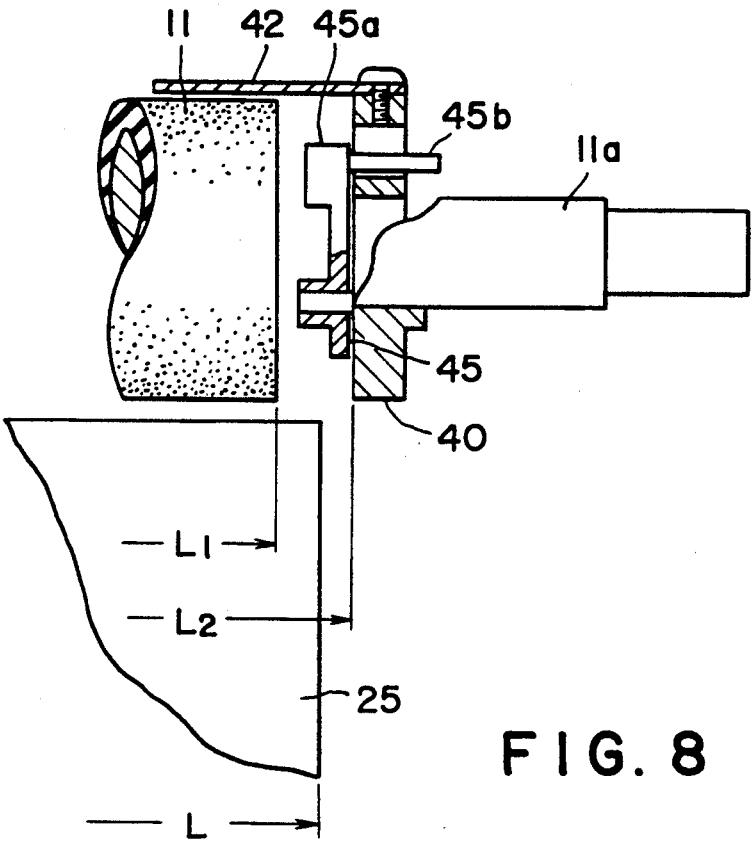
FIG. 8 is a plan view illustrating the supplied end of printing paper clamped by the clamp mechanism.

Since the width "L" of the printing paper 25, as shown in FIG. 8, is longer than the full width "L1" of the platen roller 11 and shorter than the width "L2" between positions of the respective inside walls of the ring 40, both side corners of the paper 25 are inserted between the clamp portion 42*a* of the holding member 42 and the clamp portion 45*a* of the clamp lever 45 which are separated at a predetermined interval, and the paper 25 clamped at the side corner thereof extends in the counterclockwise direction into the guide arm 23 as described hereinunder.

The lever 21 rotatably supporting the pinch roller 20 has a hole 21*a* which is made at the lower end of the lever 21 and into which the shaft 24 is inserted, and a hole 21*b* which is bored at the upper end of the lever 21 and into which the shaft 20*a* of the pinch roller 20 is inserted. A release member 51, which releases the engagement with the clutch lever 44 and the clutch ring 41, is supported by a shaft 21*c* projecting from the lever 21, and has a roller 51*a* at its pointed end. A coil spring 52 of tension type engages with an engaging portion 21*d* of the lever 21 at one end, and at the other end with a projecting portion 51*b* of the release member 51. Accordingly, as the release member is biased to rotate in the counterclockwise direction by the tension of the spring 52, the roller 51*a* makes a press-contact with the outer surface of the ring 40 in the case of the counterclockwise rotation of the lever 21.

A coil spring 54 of compression type is disposed between the lever 21 and an arm portion 53*a* of an arm 53 which is supported on the shaft 24. The arm 53 is located in the position as shown by the double-dotted line in FIG. 5, and when the lever 55 is driven in the clockwise direction, the arm 53 rotates to the position shown by the continuous line by being pushed by the roller 55*a* of the lever 55. A rotational force of the arm 53 is transmitted to the lever 21 through the coil spring 54, thereby the lever 21 rotates in the counterclockwise direction and pushes the pinch roller 20 against the platen roller 11.

In order to explain the action of the printer of this invention on the basis of the above-mentioned construction, the function of the printing paper clamping mechanism which is separately controlled in rotation from the platen roller 11, will be described with reference to the schematic diagram shown in FIG. 25 and in accordance with the function of the clutch mechanism.

Figure 25:
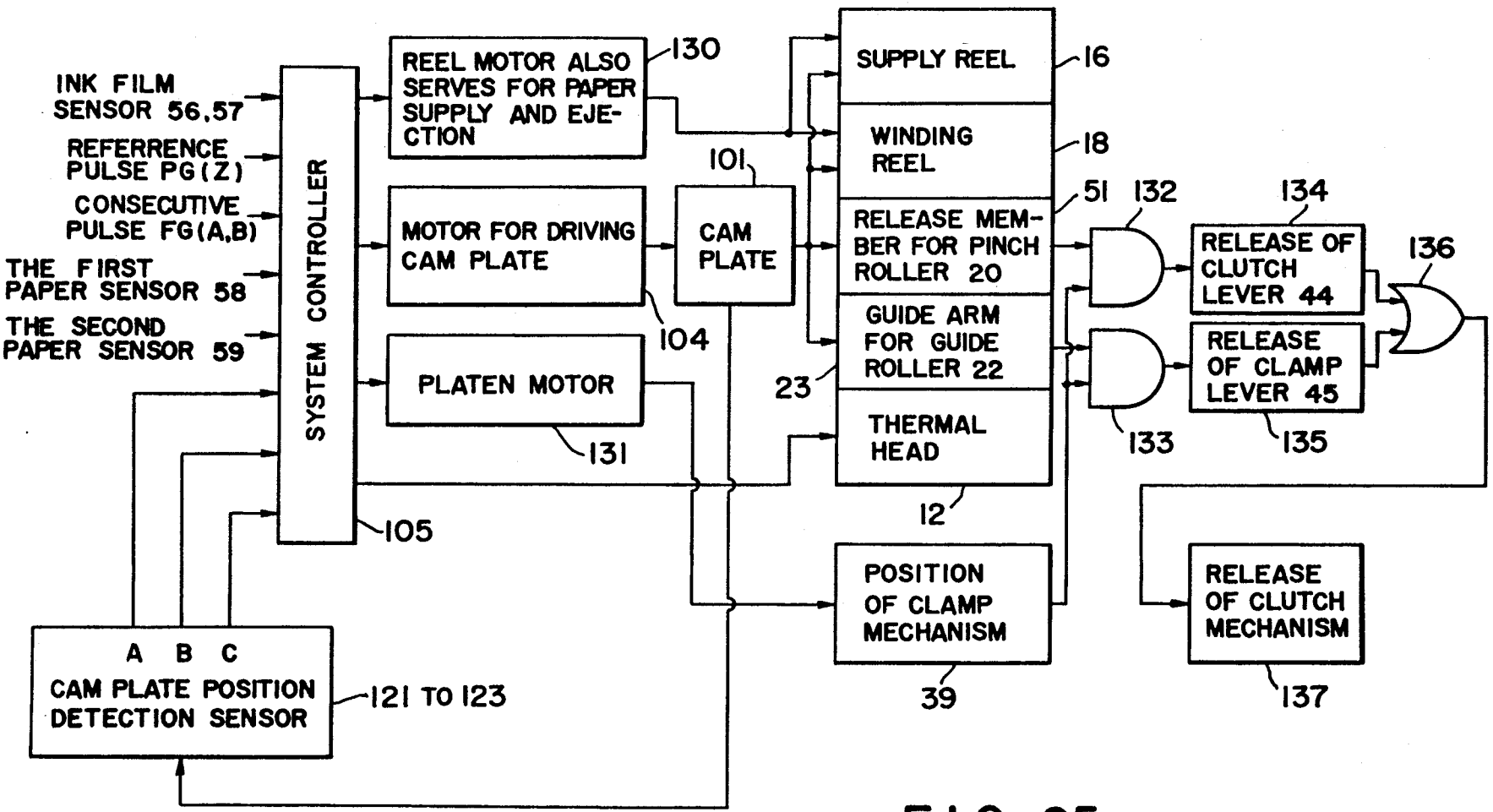
FIG. 25 is a block diagram showing a sequential control system of the clutch mechanism in the printer of this invention.

Though FIG. 25 is a functional block diagram for explaining the function of each driving part of the printer, reference numerals given to the blocks are the same numbers used for corresponding mechanical components for convenience. The cam plate 101 explained in FIG. 24 is rotated by the motor 104 for driving the cam plate, and is controlled by the system controller 105 including e.g. a micro-computer, CPU and so on. The controller 105 receives all detection signals such as those from the ink film sensors 56 and 57, the first and the second printing paper sensors 58 and 59, sensors 121 to 123 for detecting positions A to C of the cam plate 101, and the reference pulse PG(Z) and continuous pulse FG for the platen roller, inputted to it. Moreover, the controller 105 outputs all control signals to a motor 130 for driving the ink film supply and winding reels 16 and 18, a motor 104 for driving the cam plate 101, a platen motor 131, and the thermal head 12. As the motor 104 for the cam plate regulates the position of the cam plate 101, the cam plate 101 changes its position in the X direction and therefore controls positions of the ink film supply reel 16, the winding reel 18, the release member 51 for the pinch roller 20, and the guide arm 23 for the guide roller 22. The control of the platen motor 131 by the controller 105 causes the clamp mechanism 39 attached to the platen roller 11 to change the state of the clamping position. Namely, AND gates 132 and 133 are supplied with position data of the release member 51 and guide arm 23 and position data of the clamp mechanism 39. The AND gate 132 releases the clutch lever 44 on the basis of the respective positions of the release member 51 and the clamp mechanism 39 (see block 134), the AND gate 133 releases the clamp lever 45 on the basis of the respective positions of the guide arm 23 and the clamp mechanism 39 (see block 135). If either clutch lever 44 or clamp lever 45 is released, logical sum operation is performed to completely release the clutch mechanism holding the printing paper 25 (see an OR gate 136 and block 137).

The following will explain the operations for each mode of the thermal printer having the above-mentioned construction with reference to flow charts shown in FIGS. 26 to 29.

(a) Reset Mode

A reset mode will be explained by use of a flow chart shown in FIG. 26. In the standby state of the printer shown in FIG. 3, the thermal head 12, pinch roller 20 and guide roller 22 are separate from the platen roller 11 by the predetermined distance as shown in a step ST1 of FIG. 26. Since these rollers 11, 20 and 22 are formed from elastic materials such as rubber, for example, the predetermined distance prevents permanent deformation of the rollers 11, 20 and 22.

Figure 10:
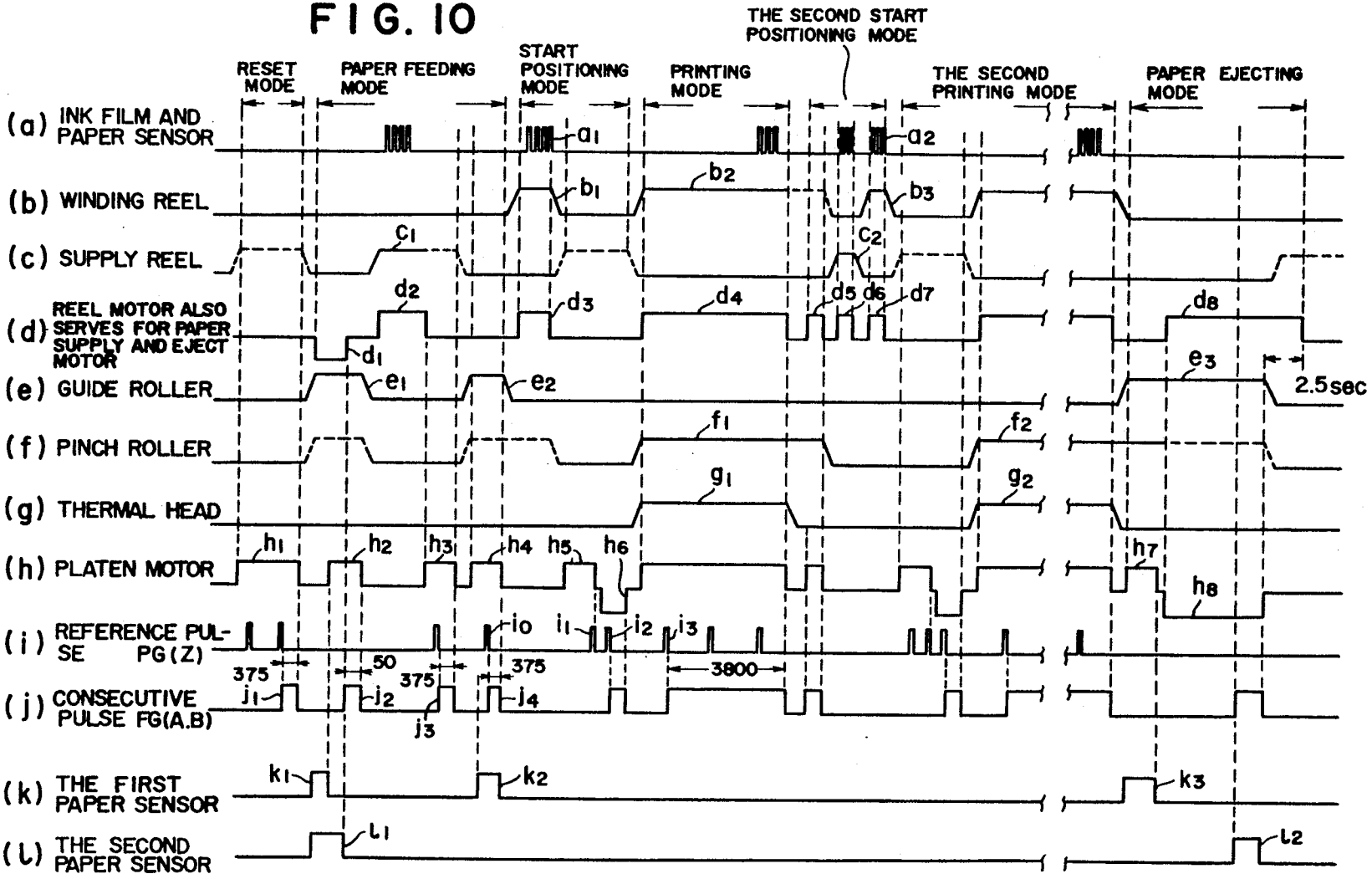
FIG. 10 is a time chart showing the movement of the printer of the above embodiment.

As the operation of the reset mode starts after the standby state, the platen roller 11 is driven in the clockwise rotation (step ST2 of FIG. 26) by the starting of the platen motor corresponding with a leading edge of pulse h1 of the waveform shown in FIG. 10(*h*). Rotation of more than 1 cycle of the platen roller 11 causes the projection 44*a* of the clutch lever 44 to enter the recess 41*a* of the clutch ring 41 by the force of pressure of the tension spring 46, therefore the ring 40 rotates with the platen roller 11 by engagement with the platen roller 11 of the ring 40. The encoder 38 outputs 2 reference pulses PG on the basis of the rotation of the platen roller 11 shown in FIG. 10(*i*). The platen roller 11 stops when the consecutive pulses increment to 375 pulses. These operations are performed on the basis of the waveform j1 shown in FIG. 10(*j*), with this group of pulses j1 of 375 pulses corresponds to a rotational angle of 90 degrees.

Figure 26:
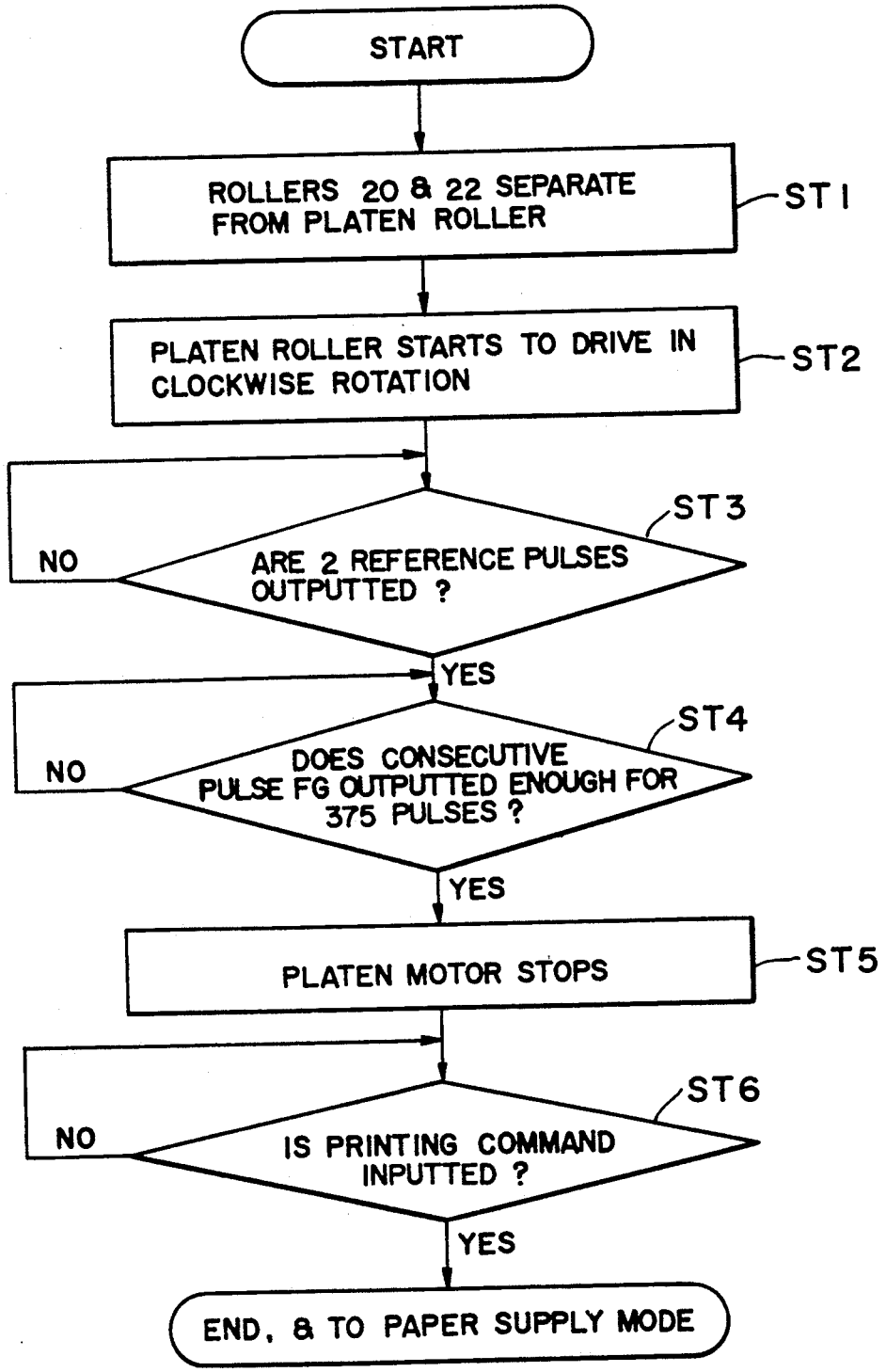
FIG. 26 is a flow chart of the reset mode, showing the movement of the printer in one embodiment of this invention.

The above operations are shown in the flow chart of reset mode in FIG. 26. In the determination step ST3, the controller 105 determines whether or not enough reference pulses PG are detected for 2 pulses. If 2 reference pulses are detected in the determination step ST4, the controller 105 determines whether or not enough consecutive pulses FG are detected for 375 pulses. After detection of 375 consecutive pulses FG, the platen roller 11 stops as shown in step ST5 of FIG. 26. Finally, in step ST6 of FIG. 26, the controller 105 determines whether or not the printing command has been inputted. If the command has been imparted, the operation of the reset mode is over and operation is performed for the following mode of paper supply.

(b) Paper Supply Mode

At first, the action of the printer of the paper supply mode will be explained referring to FIGS. 10 to 15.

Driving the shaft 55*b* of the lever 55 in the clockwise direction causes the arm 53 to rotate in the counterclockwise direction. By these rotations, the lever 21 supporting the pinch roller 20 rotates in the same direction as it is biased to do so by the spring 54, and the pinch roller 20 is pressed against the platen roller 11 as shown in FIG. 11. With the rotation of the lever 21, the release member 51 supported by the lever 21 rotates in the same direction, therefore the roller 51*a* rotates as it contacts with an outer surface of the ring 40.

At the same time, the shaft 24 is driven to rotate in the clockwise direction. As the guide arm 23 is rotated in the same direction, the guide roller 22 supported by the guide arm 23 is pressed against the platen roller 11. Furthermore, as the extended portion 23*d* touches and presses the pin 45*b*, the clamp portion 45*a* separates from the holding member 42.

Then, as shown in FIG. 11, the paper feed roller 28 is driven to rotate in the clockwise direction by the starting of a motor for both supplying and ejecting paper, as well as a reel motor, which is not shown in figures. At the same time, as the papers 25 on the tray 26 are pressed by the roller 28 moving in the downward direction, the topmost sheet of paper 25 produces a bump with the frictional force of the paper supply roller 28, as shown by symbol $\alpha$ of FIG. 11.

As the holding fingers 27 can no longer hold the paper 25 against the excessive frictional force, the supply end of the topmost paper 25 hops up, disengaged from the holding fingers 27, and moves on the inclined face 26*a* of the tray 26. Thereby, one sheet of printing paper 25 is supplied to the paper feeding path 32, and carried to the plate portion 23*a* of the guide arm 23, guided by guide plates 29 and 30. When the supplied end of the paper 25 is positioned near the pinch roller 22 and the plate portion 23*a*, the paper 25 intercepts an optical path of the first paper sensor 58 consisting of the emission element 58*a* and the receiving element 58*b*. At this time, the first paper sensor 58 outputs a paper detecting signal "k1" as shown in FIG. 10(*k*).

The detection of the paper 25 by the first sensor 58 causes the platen motor, shown schematically in FIG. 6, to start rotating again so that the paper 25 is interposed between the holding member 42 and the clamp lever 45 on the basis of the rotation of the platen roller 11 and the guide roller 22, and the paper 25 stops by contact with the holding member 42. The platen motor (not shown) stops its rotation at the time when the consecutive pulses FG is counted as 50 pulses corresponding to 12 degrees of rotation angle of the platen roller, as shown in the group of pulses "j2" of FIG. 10(*j*).

In spite of the rotation of the platen roller 11 as described above, the clamp mechanism 39 stops as the clutch lever 44 disengages with the clutch ring 41.

The clockwise rotation of the lever 21 then causes the guide arm 23 to rotate counterclockwise and causes the pinch roller 20 and the guide roller 22 to separate from the platen roller 11 as shown in FIG. 3. By these operations, the clamp lever 45 rotates counterclockwise by the spring force of the torsion spring 47 and presses the clamp portion 45*a* against the holding member 42, therefore the lever 45 and the clamp portion 42*a* of the holding member 42 clamps both sides of the supplied end of the paper 25. Though the paper 25 is clamped by only its supplied end, as the paper 25 is directly placed on the holding member 42 longer than the whole length of the platen roller 11, the paper 25 does not bend after it has been clamped.

By the waveform "d2" shown in FIG. 10(*d*), restarting the motor (not shown) for feeding and ejecting papers, which serves also as a reel motor, causes the paper feed roller 28 to rise and separate from the printing paper 25 in the tray 26.

After that, the clockwise rotation of the platen roller 11 causes the projecting portion 44*a* of the clutch lever 44 to engage the recess 41*a* of the clutch ring 41 in the clutch mechanism 400, on the basis of the waveform "h3" of the platen motor as shown in FIG. 10(*h*).

In the case of engagement with the lever 44 and the ring 41, the platen roller 11 maintains its rotation until the count of the consecutive pulses increments to 375 corresponding to a 90 degrees rotation angle, after the output of the reference pulse. The reason for this state, as described above, resides in that the recess 41*a* of the clutch ring 41 is ahead of the position of the projecting portion 45*a* of the clamp lever 45, on the basis of conveying the paper 25 onto the holding member 42 by the rotation of the roller 11.

Figure 12:
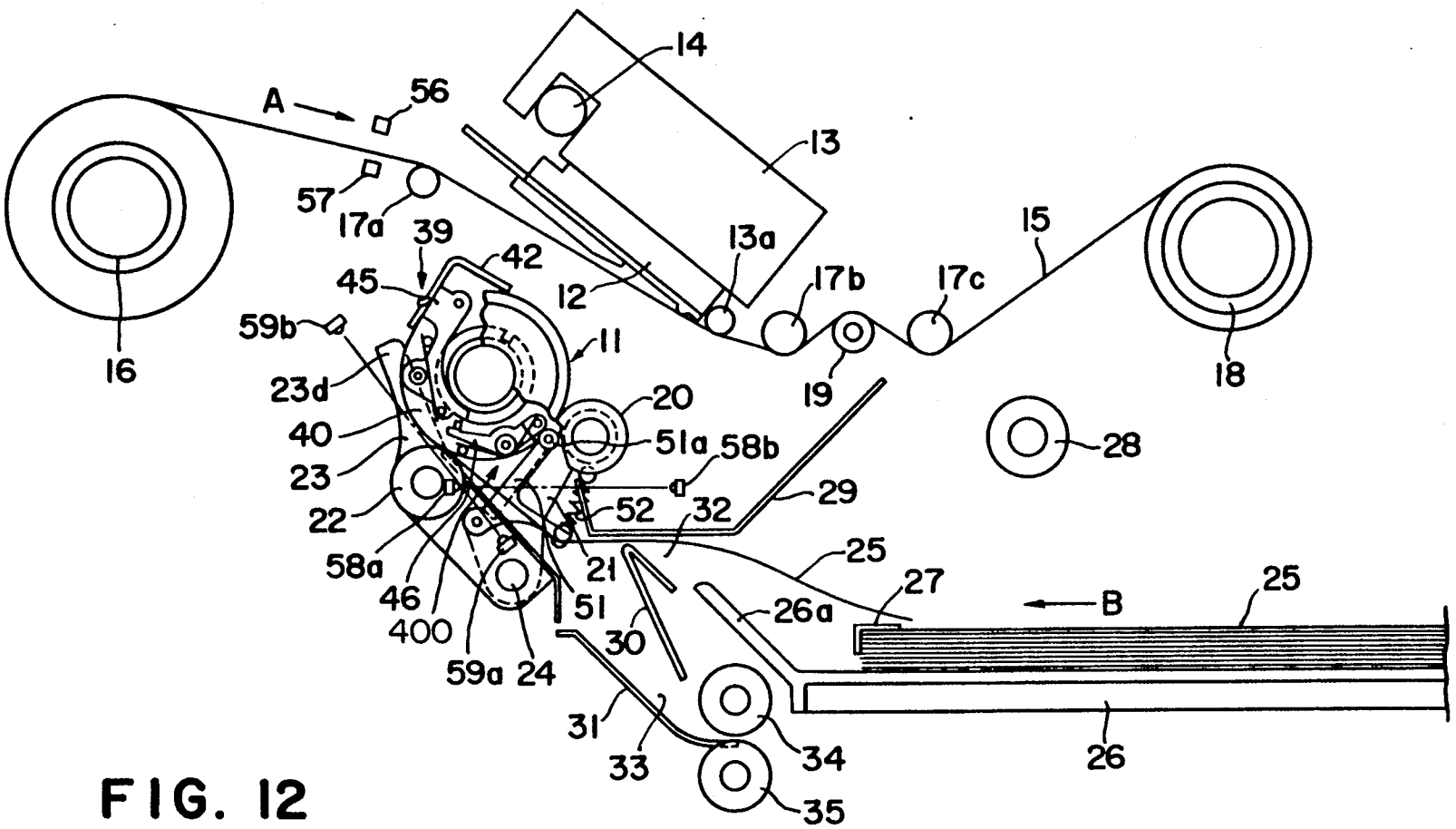

The rotation of the platen roller 11 continues, shown in FIG. 12, until the detection of counting 50 pulses of the consecutive pulses corresponding to a rotation angle of 12 degrees. Then, the pinch roller 20 and the guide roller 22 are again pressed against the platen roller 11. In this state, as the platen roller 11 rotates 12 degrees, the clamp lever 45 is displaced from the position where it clamped paper 25 before and the pin 45*b* does not touch the extended portion 23*d* of the guide arm 23, there is no chance that the clamp state is released.

Furthermore, the clockwise rotation of the platen roller 11 by the waveform "h4" of FIG. 10(*h*), as pressed against the pinch roller 20 and the guide roller 22, causes the clamp mechanism 39 to rotate unitarily and to cause the paper 25 to wind around the outer surface of the platen roller 11. Then, as shown in FIG. 12, the roller 51*a* of the release member 51 drops into the recess 40*c* of the ring 40, and the roller 51*a* presses the pin 44*b* of the clutch lever 44. In this state, the clutch lever 44 rotates counterclockwise against the torsion spring 46 and is released from engagement with the clutch ring 41. As the result of this release, the clamp lever 45 and the holding member 42 stop rotating, but the platen roller 11 continues to rotate.

Figure 13:
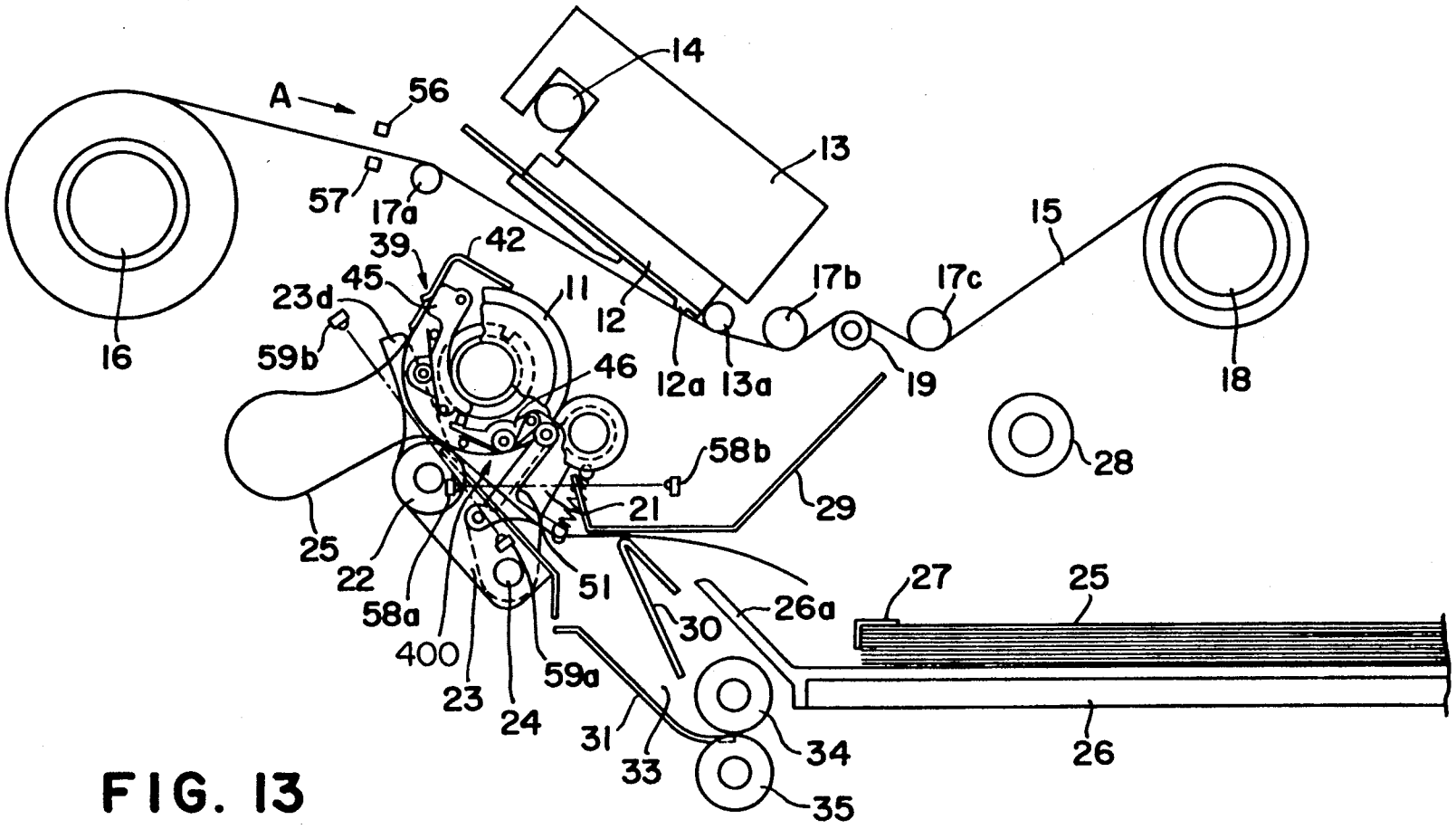

The supplied end of the paper 25 is not still when clamped, as shown in FIG. 13, but the paper 25 itself, is carried leftward in the figure by passing between the platen roller 11 and the guide roller 22 by means of the rotation of the platen roller 11, so that the printing paper 25 continues to be fed toward the platen roller 11 with the mid portion of the paper becoming drooped.

Figure 14:
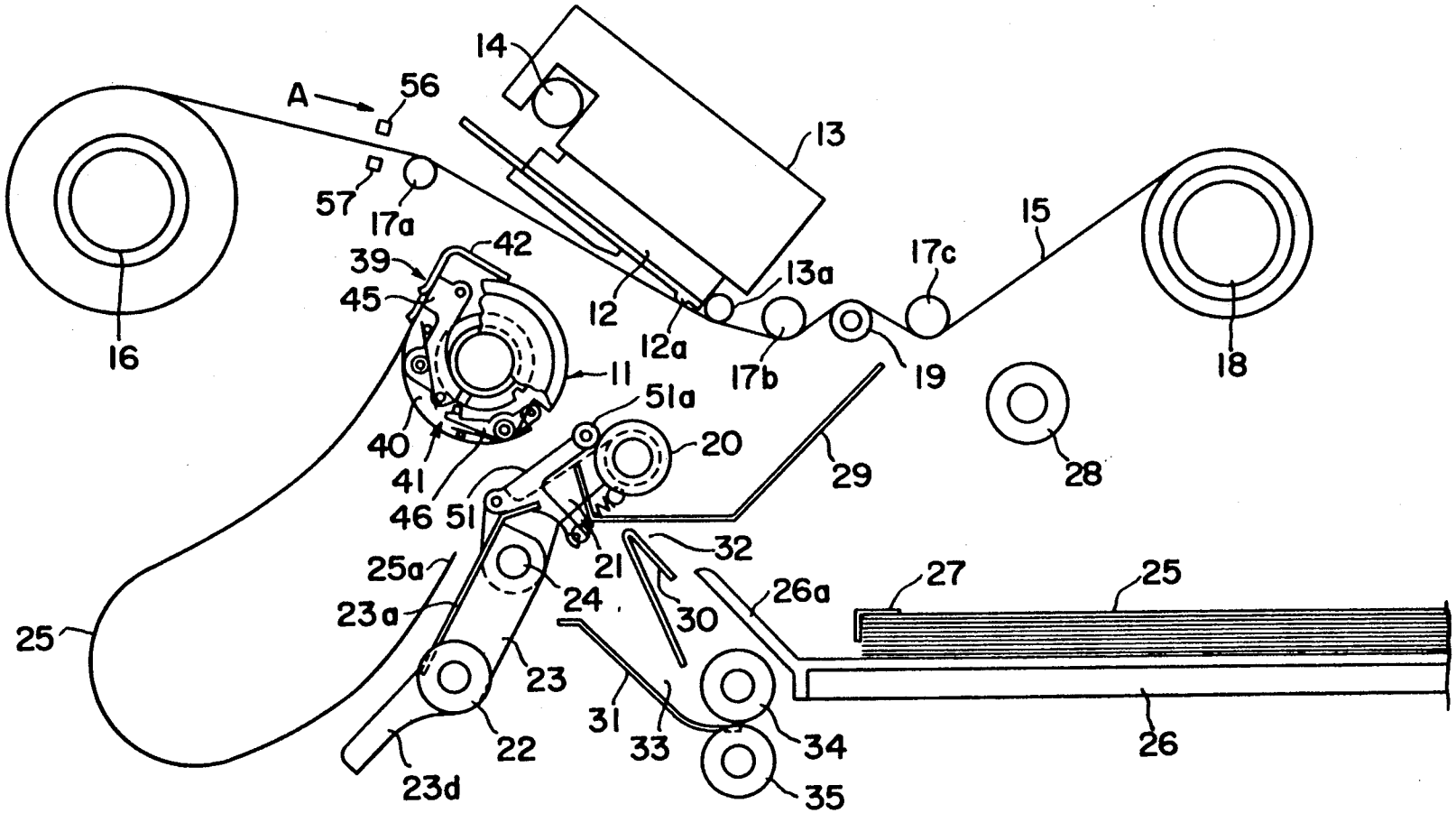

Continuous rotation of the platen roller 11, as shown in FIG. 14, causes the other end of the paper 25 to also pass through the paper feeding path 32 and pass between the emission element 58*a* and the receiving element 58*b* of the first paper sensor 58 (FIG. 11). The first sensor 58 outputs the detecting signal "k2" as the leading edge of the pulse shown in FIG. 10(*k*). After the output of the reference pulse "i0" shown in FIG. 10(*i*), the count of the 375 consecutive pulses FG causes the platen motor to stop.

Figure 27:
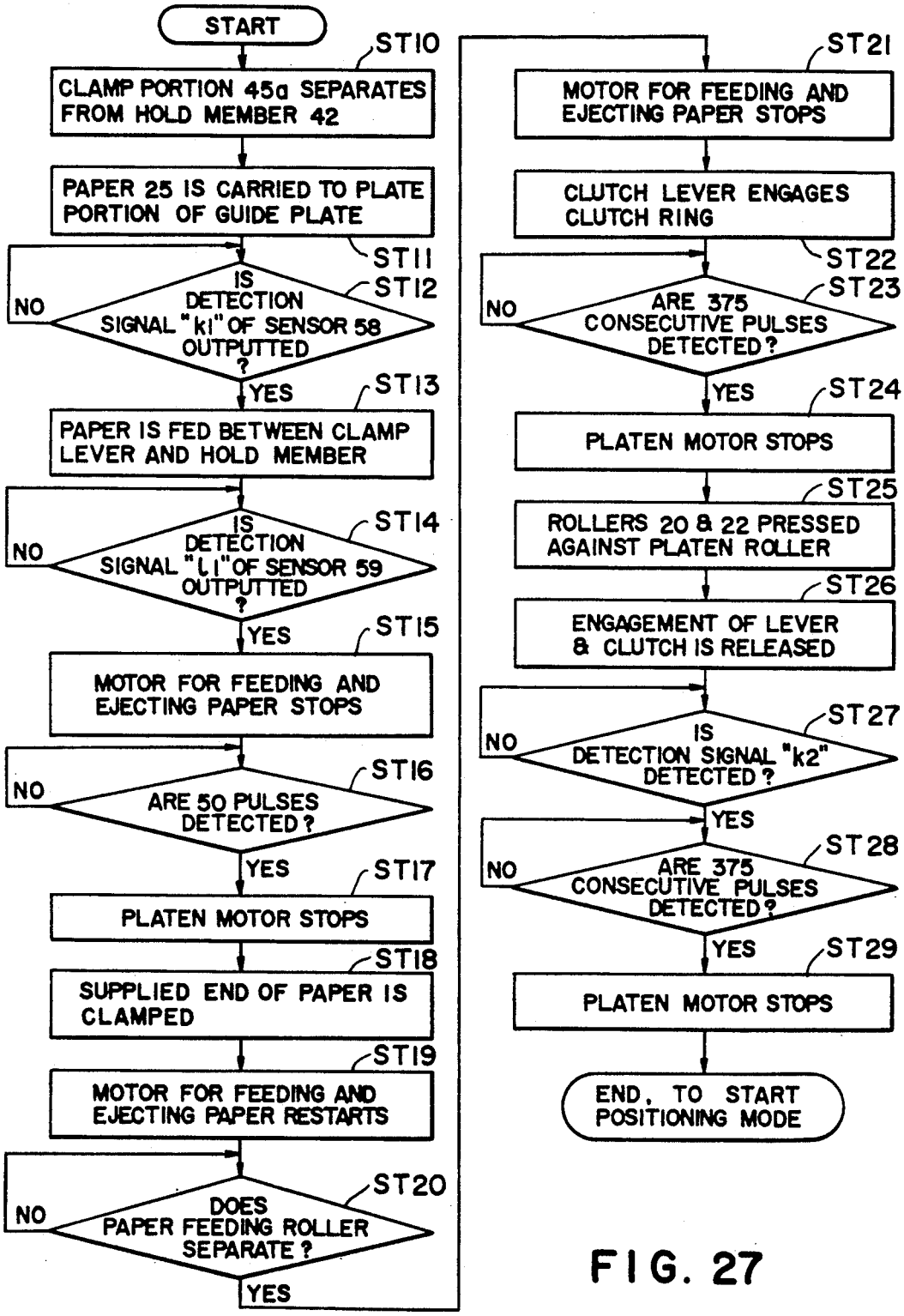
FIG. 27 is a flow chart of a paper feeding mode, showing the movement of the printer in one embodiment of this invention.

Next, the steps of the paper supply mode will be described by using the flow chart shown in FIG. 27.

On the step ST10, the controller 105 causes the pinch roller 20 and the guide roller 22 to press against the platen roller 11 and causes the clamp portion 45*a* to separate from the holding member 42. The controller 105 causes the motor (serving also as the reel motor) for feeding and ejecting the paper by the roller 28 to start, and the paper 25 is carried to the plate portion 23*a* of the guide plate 23 as shown in step ST11 of FIG. 27. The controller 105 determines whether or not the first paper detection signal "k1" is outputted (see step ST12). If the signal "k1" is outputted, the starting of the rotation of the platen roller 11 causes the paper 25 to be fed between the clamp lever 45 and the holding member 42 shown in step ST13.

In step ST14, the controller 105 determines whether or not the second paper sensor 59 outputs the paper detection signal "l1". If the signal "l1" is detected, the motor for feeding and ejecting the papers stops as shown in step ST15. In step ST16, during the rotation of the platen motor, the controller 105 judges whether the consecutive pulses are counted amounting to 50 pulses or not. If 50 consecutive pulses are detected in FIG. 10(*j*), the controller 105 causes the platen roller 11 to stop in step ST17. With this, the pinch roller 20 and the guide roller 22 separate from the platen roller, and at the same time, the supplied end of the printing paper 25 is clamped between the clamp portion 42*a* and the clamp portion 45*a* in step ST18.

Next, the motor for feeding and ejecting papers (hereinafter called "paper feeding motor") restarts by the signal "d2" in FIG. 10(*d*) as shown in step ST19, and the paper feeding roller 28 moves upward and separates from the paper 25. In step ST20, the controller 105 determines whether or not the paper feeding roller 28 separates from the paper 25 in the tray 26. If the roller 28 is separated from the paper 25, the paper feeding motor is controlled to stop as shown in step ST21.

At the same time as the paper feeding motor stops, the platen roller 11 starts again to rotate clockwise so that this rotation causes the clutch lever 44 to engage with the clutch ring 40 as shown in step ST22. During the rotation of the platen roller 11, the controller 105 determines whether or not 375 consecutive pulses have been detected since the detection of the reference pulse (see FIGS. 10(*h*), (*i*) and (*j*) and step ST23 of FIG. 27).

If the controller 105 detects 375 consecutive pulses, the platen motor stops again as shown in step ST24. In step ST25, the pinch roller 20 and guide roller 22 start to rotate and are pressed against the platen roller 11. The platen roller 11 starts to rotate clockwise again and this rotation of the platen roller causes the clutch lever 44 to separate from the clutch ring 41 against the spring force of the torsion spring 46 and for the paper 25 to be fed deeper as shown in step ST26.

Then, the controller 105 determines whether or not the detection signal "k2" of the first paper sensor 58 has been outputted, as shown in step ST27. If the signal "k2" is detected and the reference pulse "i0" is given, the controller 105 determines whether or not 375 consecutive pulses are counted as shown in step ST28. When 375 consecutive pulses have been detected, the platen motor 11 stops as step ST29 and the paper supply mode is completed.

(c) Start Positioning Mode

After that, as shown by the pulse "d3" in FIG. 10(*d*), the winding reel 18 for the ink film 15 is driven to rotate clockwise. The ink film 15, as mentioned before, has formed on its surface the 4 color patterns of yellow, cyan-blue, magenta and black arranged in order. Accordingly, the optical sensor 56 detects the positions of each color pattern by the markers mentioned before.

For example, in the case where the optical sensor 56 detects four pulses as shown in FIG. 10(*a*), that color is detected as "yellow" and the starting position of the color frame is determined by stopping the winding reel 18 on the basis of the "yellow" color detection signal. In this embodiment, the optical sensor 56 outputs three pulses in the case of the "cyan-blue" color pattern, two pulses in the case of the "magenta", and one pulse in the case of the "black".

The pinch roller 20 and the guide roller 22 separate from the platen roller 11 on the basis of the positional change of the cam plate 101.

Figure 15:
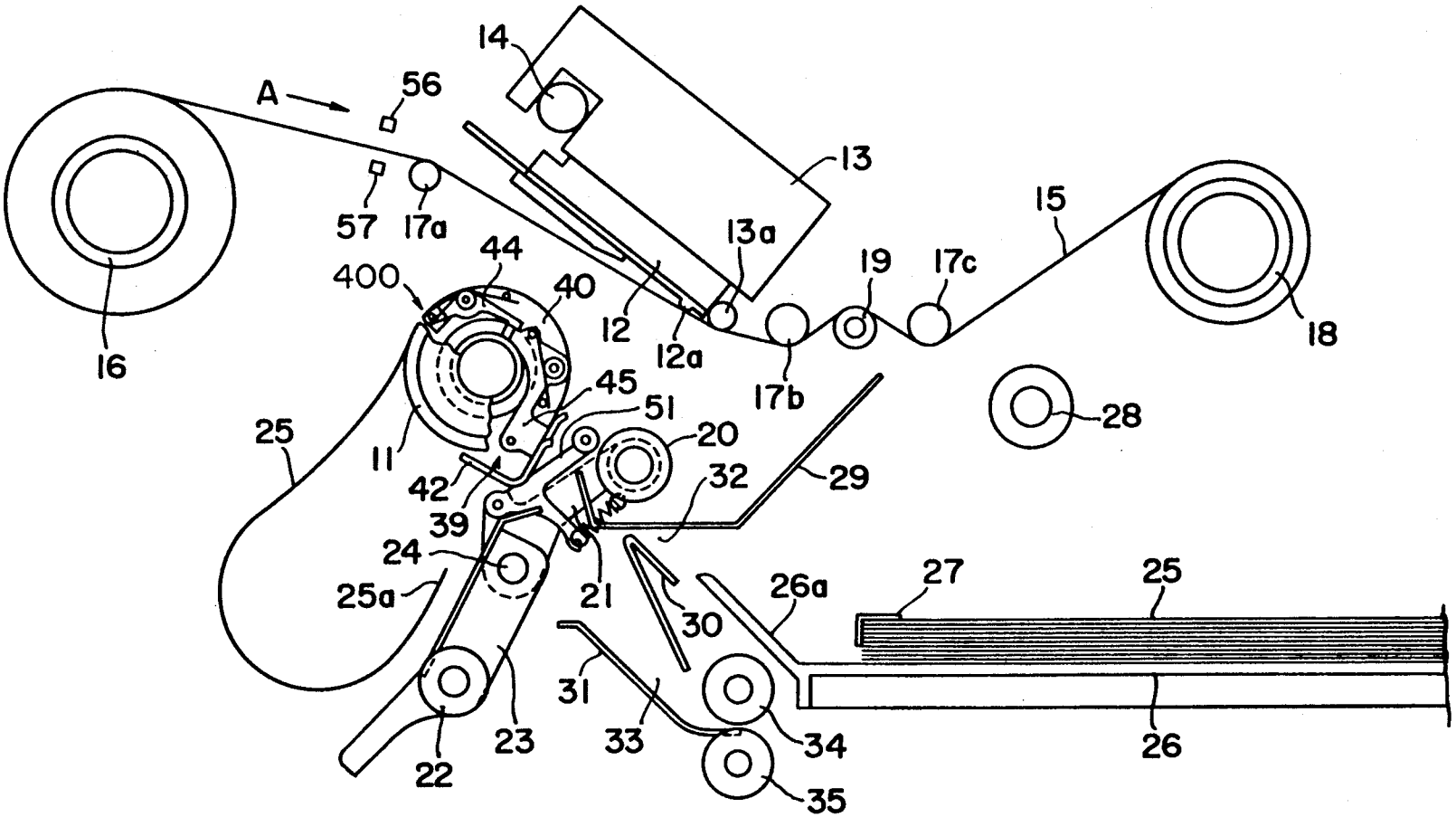
FIGS. 15 through 19 are front views showing the movement of the printer in the printing mode.

Upon starting the start positioning mode, the clamp mechanism 39 is at 180 degrees past position in the clockwise direction from its reference position shown in FIG. 15, and the platen roller 11 is at 90 degrees past position (375 consecutive pulses "j4"), respectively. From the position above, the platen roller 11 makes further clockwise turn corresponding to the waveform "h5", during which the clutch lever 46 engages with the clutch ring 41 when the platen roller 11 has made a first 90 degrees turn, thereafter the platen roller 11 makes further and approximately 180 degrees turn together with the clamp mechanism 39 fixed thereto to the position shown in FIG. 15 until the reference pulse "i1" is outputted.

Here, as the reference pulse "i1" is outputted, the platen roller 11 stops in the position shown in FIG. 15. However, the platen roller 11 tends to pass beyond the reference position shown in FIG. 15. In order to correct the overshoot, the output of the waveform "h6" which is negative going wave as shown in FIG. 10(*h*) is applied to cause the platen roller 11 to rotate in the counterclockwise direction. After obtaining the reference pulse "i2" shown in FIG. 10(*i*), the controller 105 counts five pulses and causes the platen motor 11 to stop.

Figure 28:
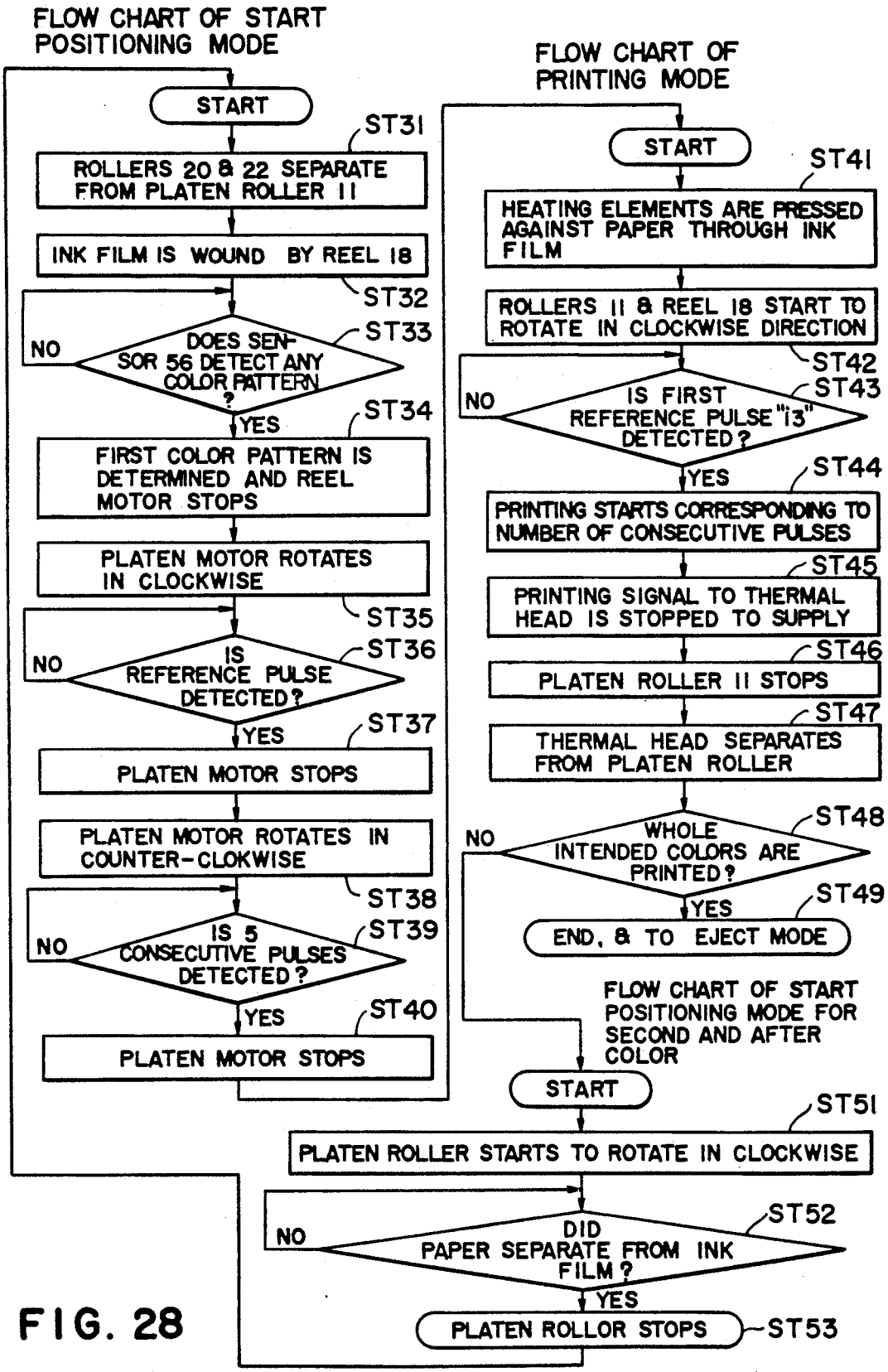
FIG. 28 is a flow chart of a start positioning mode and a printing mode, showing the movement of the printer in one embodiment of this invention.

The above operations of the start positioning mode are explained as the operation of the system controller 105 by using steps ST31 to ST40 shown in FIG. 28.

In step ST31, the pinch roller 20 and the guide roller 22 separate from the platen roller 11 by the positional change of the cam plate 101. The ink film 15 is wound by the reel 18 on the basis of the waveform "d3" of FIG. 10(*d*), as shown in step ST32.

The controller 105 judges whether the optical sensor 56 detects the first color to be printed among the four colored patterns by detecting the pulse or pulses shown in FIG. 10(*a*), as shown in step ST33.

If the first color pattern in the color frame is detected, the color to be printed first is determined and the reel motor for the winding reel stops as shown in step ST34. The platen motor rotates clockwise by the waveform "h5" (shown in step ST35). Then the controller 105 determines whether the reference pulse is detected or not as shown in step ST36. If the reference pulse is detected, in step ST37, the platen motor stops in step ST37.

Then, as platen roller 11 rotates beyond the reference position, the platen roller rotates in the counterclockwise direction in step ST38. In step ST39, the controller determines whether or not the consecutive pulses are detected as 5 pulses after the detection of the reference pulse. If 5 pulses are obtained, the platen roller stops to counter-rotate as indicated in step ST40.

(d) Printing Mode

Figure 16:
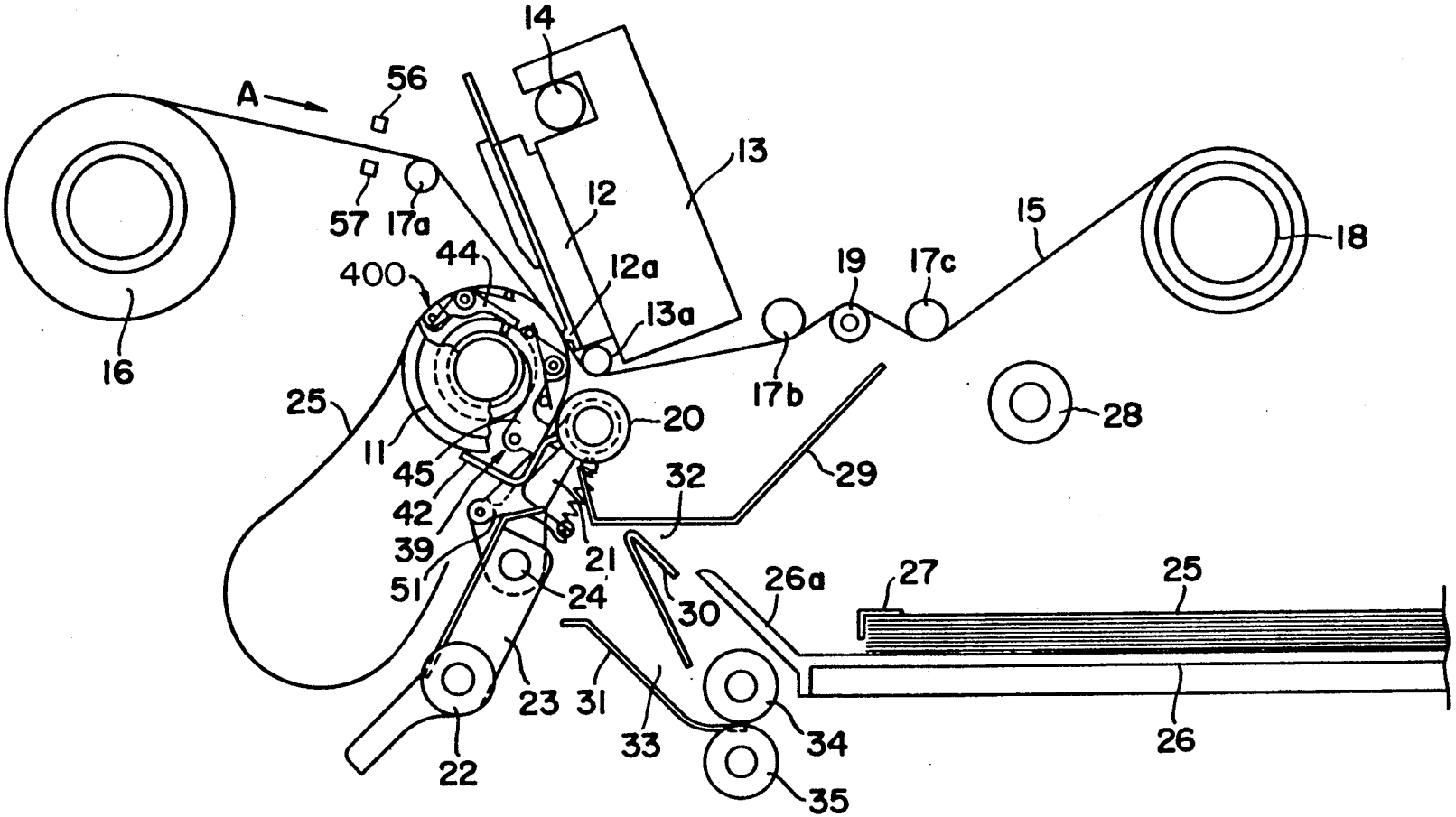

When the holding member 13 of the thermal head 12 rotates in the clockwise direction as shown in FIG. 16, the heating element 12*a* of the thermal head 12 is pressed against the printing paper 25 wound around the platen roller 11 through the ink film 15 on the basis of the waveform (driving signal) shown in FIG. 10(*g*). As the ink film 15 is pressed against the heating element 12*a* and the roller 13*a* between the guide rods 17*a* and 17*b*, the film 15 touches the paper 25 without there being any slack.

The pinch roller 20 presses down the paper 25 on the platen roller 11 by the counterclockwise rotation of the lever 21. At this point, the printer is capable of printing.

The reference pulse "i3" shown in FIG. 10(*i*) is outputted as soon as the platen roller 11 rotates in the clockwise direction, and the predetermined printing is performed in response to the number of consecutive pulses counted in rotation to the pulse "i3" as the starting point of the printing. The winding reel 18 rotates in the clockwise direction with the rotation of the platen roller 11 and on the basis of the waveform shown in FIG. 10(*b*), to wind the ink film 15. The driving signal for printing is supplied to the thermal head 12 with the rotation of the platen roller.

In this embodiment, the controller performs the printing in lines corresponding to 3,800 consecutive pulses. Namely, as 1,500 pulses are obtained per 1 revolution of the platen roller 11, it is possible to print the paper corresponding to the length of two and a half rotations of the platen roller 11.

In this printing mode, the guide roller 22 is kept away from the platen roller 11, and the roller 11 is pressed by the pinch roller 20. The reason for this configuration is that the feed of the paper for printing is not disturbed by the contact of the guide roller 22 with the paper 25 which is drooped under the platen roller 11, and that it makes it possible to print the paper 25 longer than the circumference of the outer surface of the platen roller 11.

Figure 17:
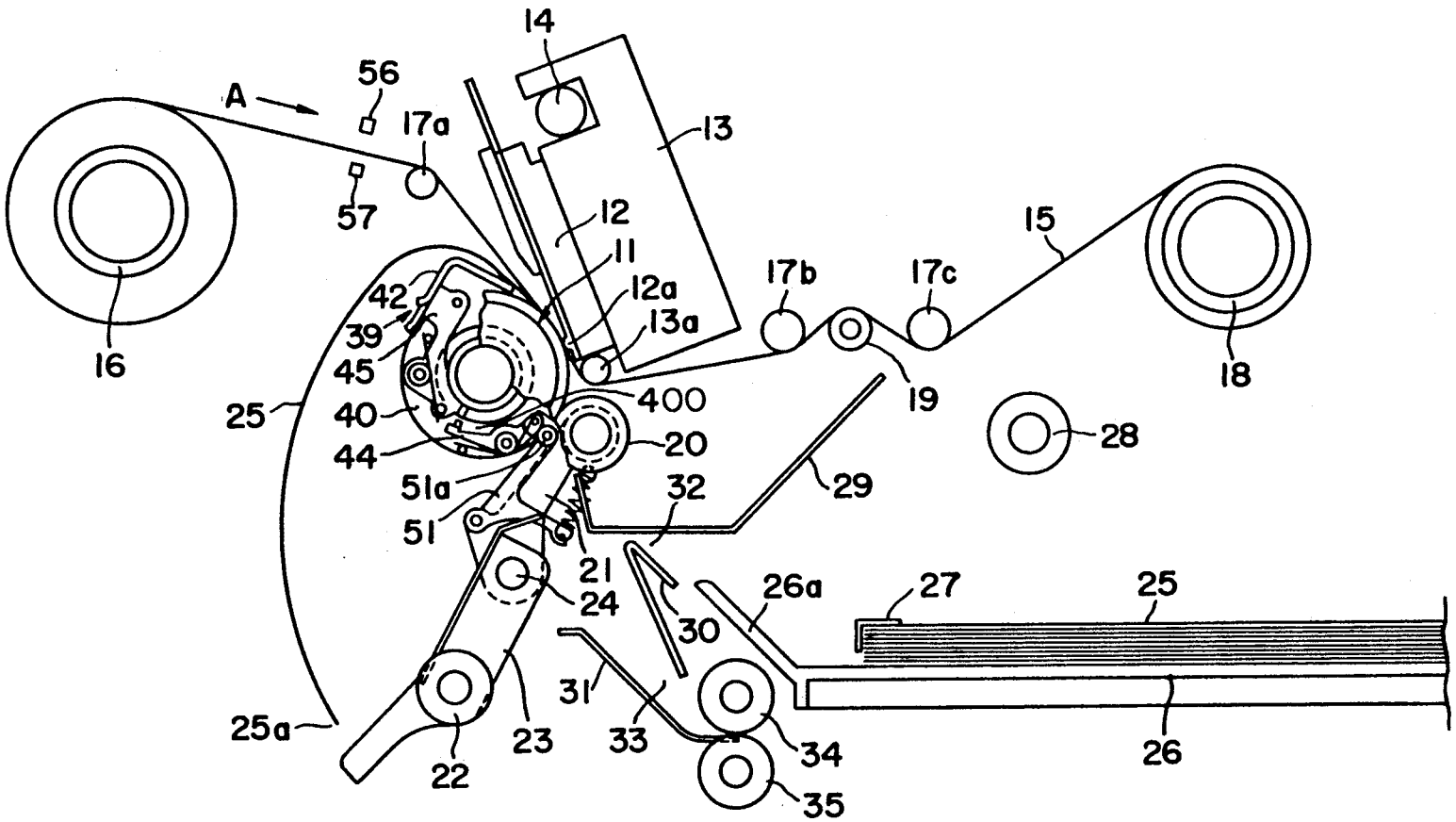

As the printing starts by the rotation of the platen roller 11 shown in FIG. 17, the roller 51*a* of the release member 51 rotates with the rotation of the platen roller 11 until the roller 51*a* causes the clutch lever 44 to rotate in the release direction in the state where the clamp mechanism 39 continues to clamp the paper 25. With the conveyance of the paper 25, the ink film 15 moves in the direction of the arrow A in FIG. 3, and the ink on the ink film 15 is heated and melted while contacting the heating element 12*a*, thereby transferring the ink to the printing paper 25.

Figure 18:
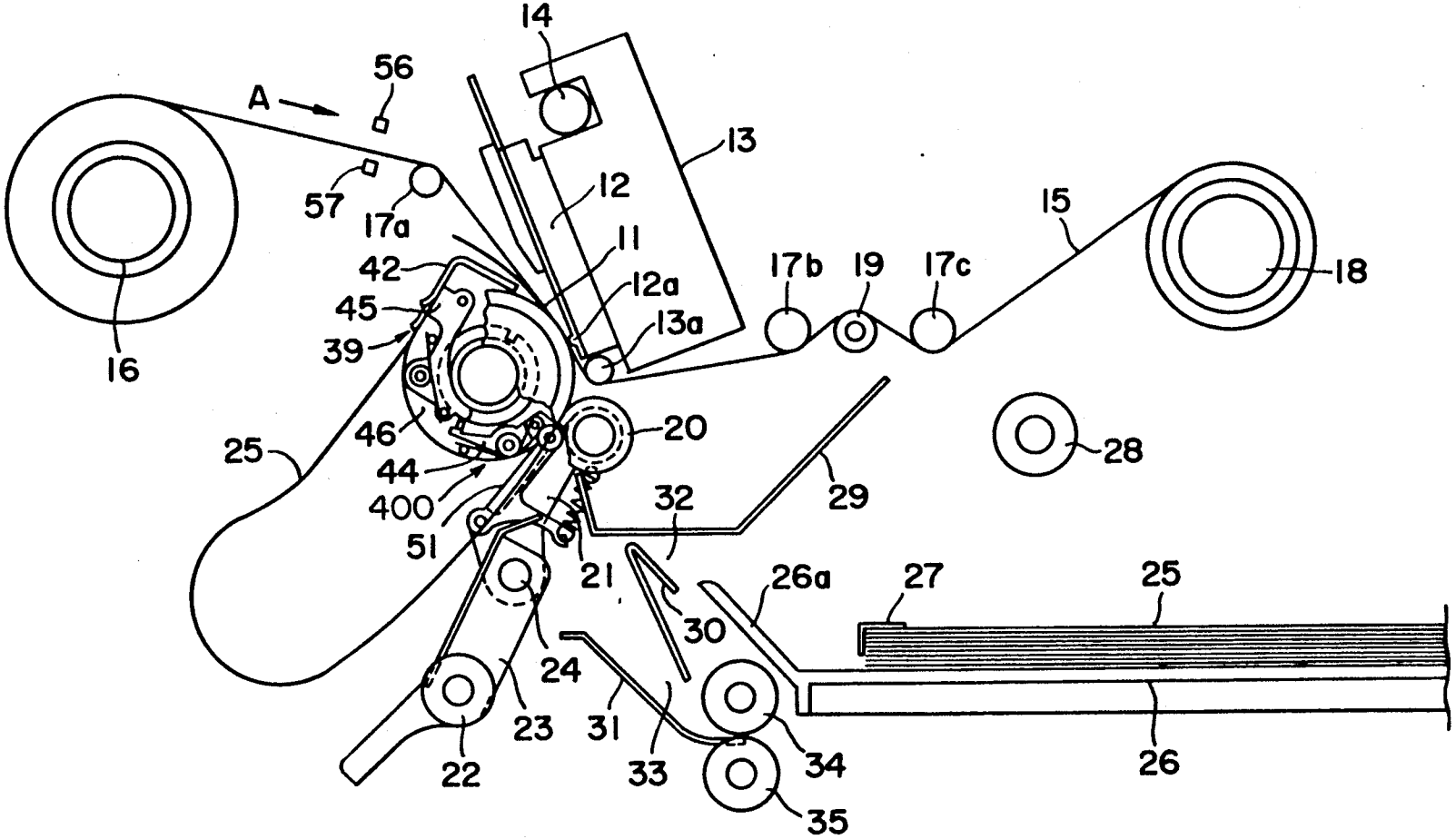

When the platen roller 11 rotates 180 degrees after the start of printing, as shown in FIG. 18, the clamp mechanism 39 stops as shown in FIG. 18 by releasing the engagement with the clutch lever 44 and the clutch mechanism 400. After that, the paper 25 printed by facing the heat element 12*a* of the thermal head 12 is conveyed under the platen roller 11 being advanced by the platen roller 11 and the pinch roller 20.

Figure 19:
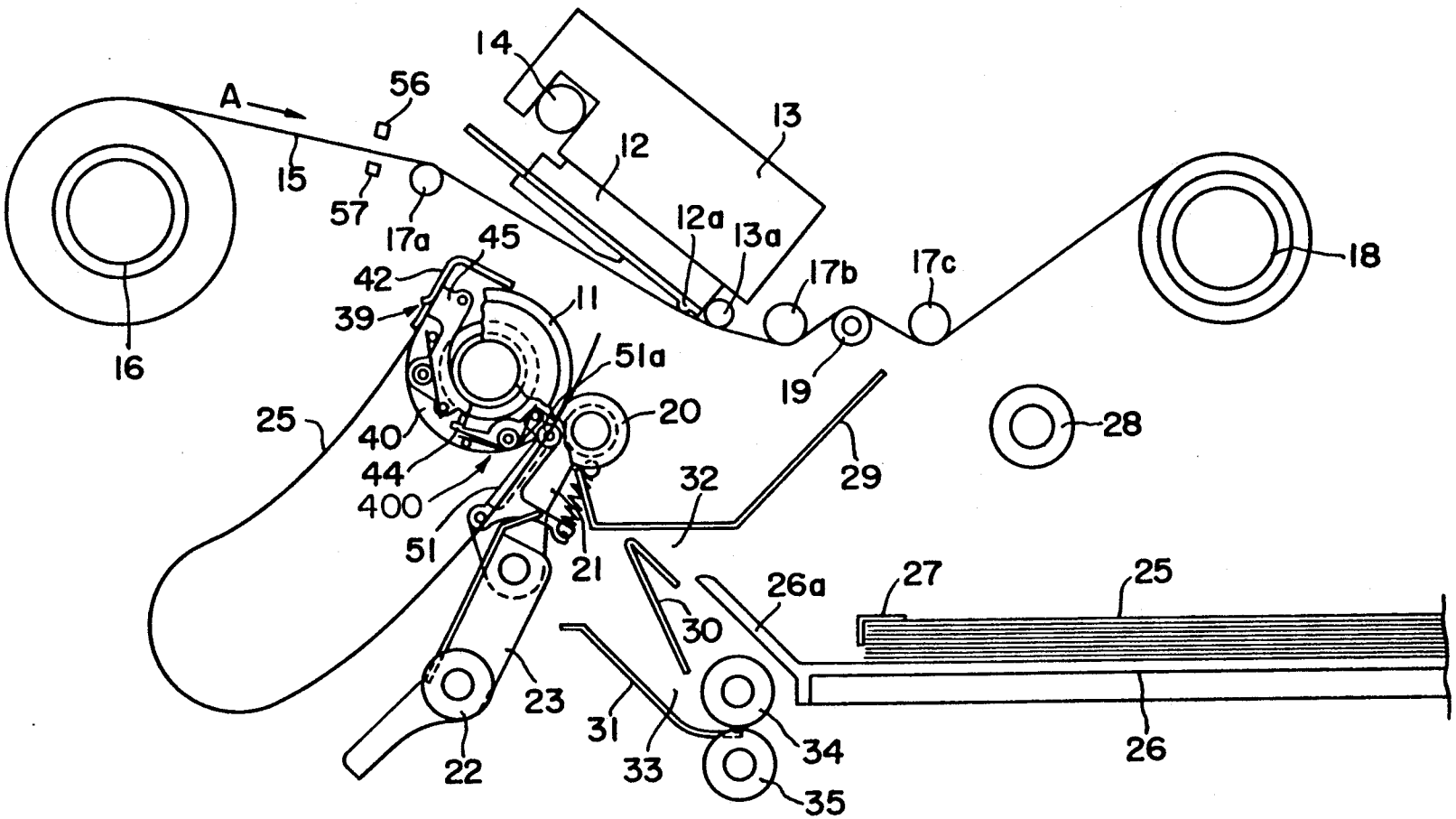

Accordingly, after the supplied end of the paper 25 stops, the paper 25 is conveyed with the rotation of the platen roller 11 in order to continue the printing. As 3800 consecutive pulses are counted after the start of rotation of the platen roller 11, as shown in FIG. 19, the printing is over when the supply of the driving signal is stopped. At the same time, as the holding member 13 of the thermal head 12 rotates in the counterclockwise direction, the thermal head 12 separates from the platen roller 11. At this time, the other end of the printing paper 25 is clamped between the platen roller 11 and the pinch roller 20.

As described above, in the case where the second and third printing modes in accordance with the subsequent color patterns such as "cyan-blue" and "magenta", respectively, are continuously performed after the first printing mode, the platen roller 11 is further rotated in the clockwise direction as shown in FIG. 19. By this operation, the paper 25 returns to the state before the start of the printing as shown in FIG. 14, and is clamped by both rollers 11 and 20. Since the "yellow" color pattern on the ink film 15 is used already at the first printing in yellow, the starting position of the second color such as "cyan-blue" color pattern is used to be sensed by the optical sensor 56 as winding the ink film 15 to the position.

After that, printing modes in accordance with the second and third color patterns are performed by repeating operations of the first printing mode shown in FIGS. 14 to 19. During the second to fourth printing modes, as the printing paper 25 is held by the holding member 42, the printing also starts at the start point of the reference pulse obtained by the encoder 38, and though colors such as "cyan-blue" and "magenta" are subsequently printed after "yellow", it is possible to precisely print in colors without color misregistration since the paper 25 is kept to the platen roller 11.

Furthermore, since the printing paper 25 is securely held by the pressure of the pinch roller 20 and the thermal head 12, the paper 25 does not displace on the platen roller 11. Accordingly, it is unnecessary to have the clamping force of the clamp lever 45 strong enough to keep the paper from slipping due to the dragging force generated by the pressed down thermal head, and therefore the clamping force of the clamp mechanism 39 can be reduced to a lower force simply capable of conveying the paper 25 to the starting position for printing.

The above operations of the printing mode will be explained as the operation of the system controller 105 by using steps ST41 to ST49 and steps ST51 to ST53 shown in FIG. 28.

In step ST41, the heating element 12*a* of the thermal head 12 is pressed to the paper 25 through the ink film 15 by partial rotation of the holding member 13. The platen roller 11 and the winding reel 18 start to rotate in the clockwise direction, as shown in step ST42. In step ST43, the controller 105 determines whether or not the first reference pulse "i3" in its mode is detected. If the pulse "i3" is detected, printing for counting 3800 consecutive pulses is performed as step ST44. When the printing is over, the controller 105 stops the supply of the drive signal "g1" to the thermal head 12 as shown in step ST45. At the same time, the platen roller 11 stops the rotation, as step ST46, and in step ST47, the thermal head 12 separates from the platen roller 11.

Finally, as step ST48, the controller 105 determines whether or not all colors intended to be printed have been printed. For multi-color printing and when a color pattern is detected to be left unadvanced after the first color printing, the operation moves to the start positioning mode as shown in steps ST51 to ST53 of the flow chart in FIG. 28. In the case where all color patterns to be printed have been finished, the operation of this printing mode is over and the operation moves to the paper ejecting mode.

The starting position of the desired color pattern is determined in the start positioning mode after the first color being printed. The controller 105 makes the platen roller 11 start the clockwise rotations in step ST51. During this rotation of the roller 11, the controller 105 determines whether or not the paper 25 is separated from the ink film 15, that is, there has to be a time interval so that the paper 25 can be separated from the film 15 by the rotation of the platen roller 11 in step ST51. If the paper 25 is entirely separated from the film 15, the controller 105 makes the platen roller 11 stop as shown in ST53.

Operations after step ST53 are the same as for the start positioning mode for the first color as shown in steps ST31 to ST40, and the operations of the printing mode for the second color are the same as in the printing mode of the first color as shown in steps ST41 to ST48.

(e) Paper Ejecting Mode

Figure 20:
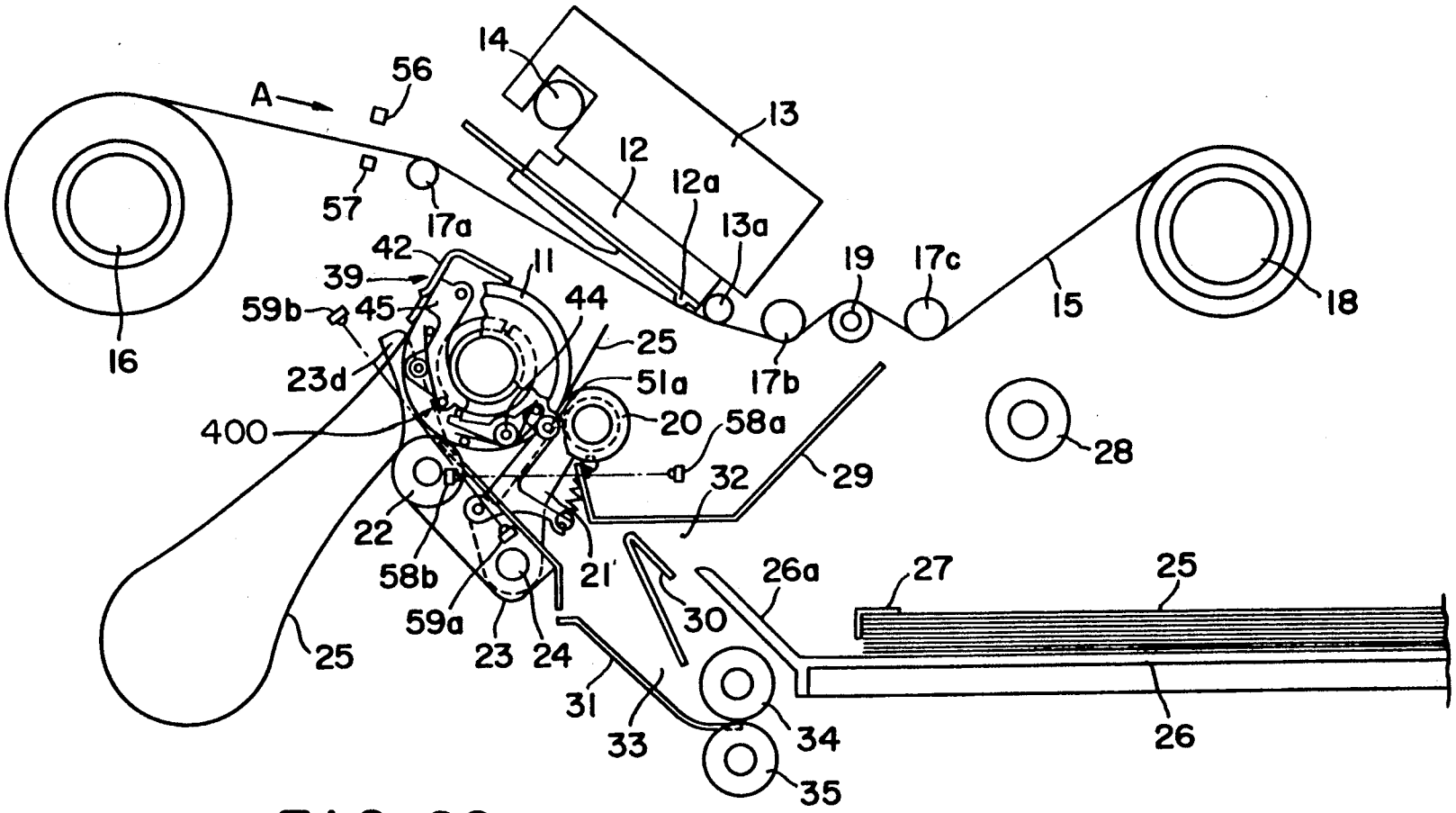
FIGS. 20 through 23 are front views, showing the movement of the printer in the paper eject mode.

After the color printing has been entirely performed of four colors such as yellow, cyan-blue, magenta and black, or after printing by an only black ink, the guide arm 23 rotates clockwise from the position of FIG. 19 to the one of FIG. 20 and causes the guide roller 22 to press against the platen roller 11. By this operation, as the printing paper 25 is clamped at its supply end by the clamp mechanism 39, the other end is caught by the pinch roller 20, the guide roller 22 and the platen roller 11. With the guide arm 23 rotated in the clockwise direction to make the guide roller 22 press against the platen roller 11, the clamping state is maintained unreleased. Because the clamp lever 45 does not contact with the extended portion **23*d* of the guide arm 23 since the clamp mechanism 39** is at the upper position which is rotated 180° from the reference position.

As the platen roller 11 rotates clockwise on the basis of the waveform "h7" of the pulse wave in FIG. 10(*h*), the other end **25*a* of the paper 25 intercepts the optical path between the emission element 58*a* and the receiving element 58*b* of the first paper sensor 58 after passing through the pinch roller 20. By this interception, the first sensor 58 outputs the detection signal "k3" which detects the other end portion 25*a* of the paper, as shown in FIG. 10**(*k*).

Figure 21:
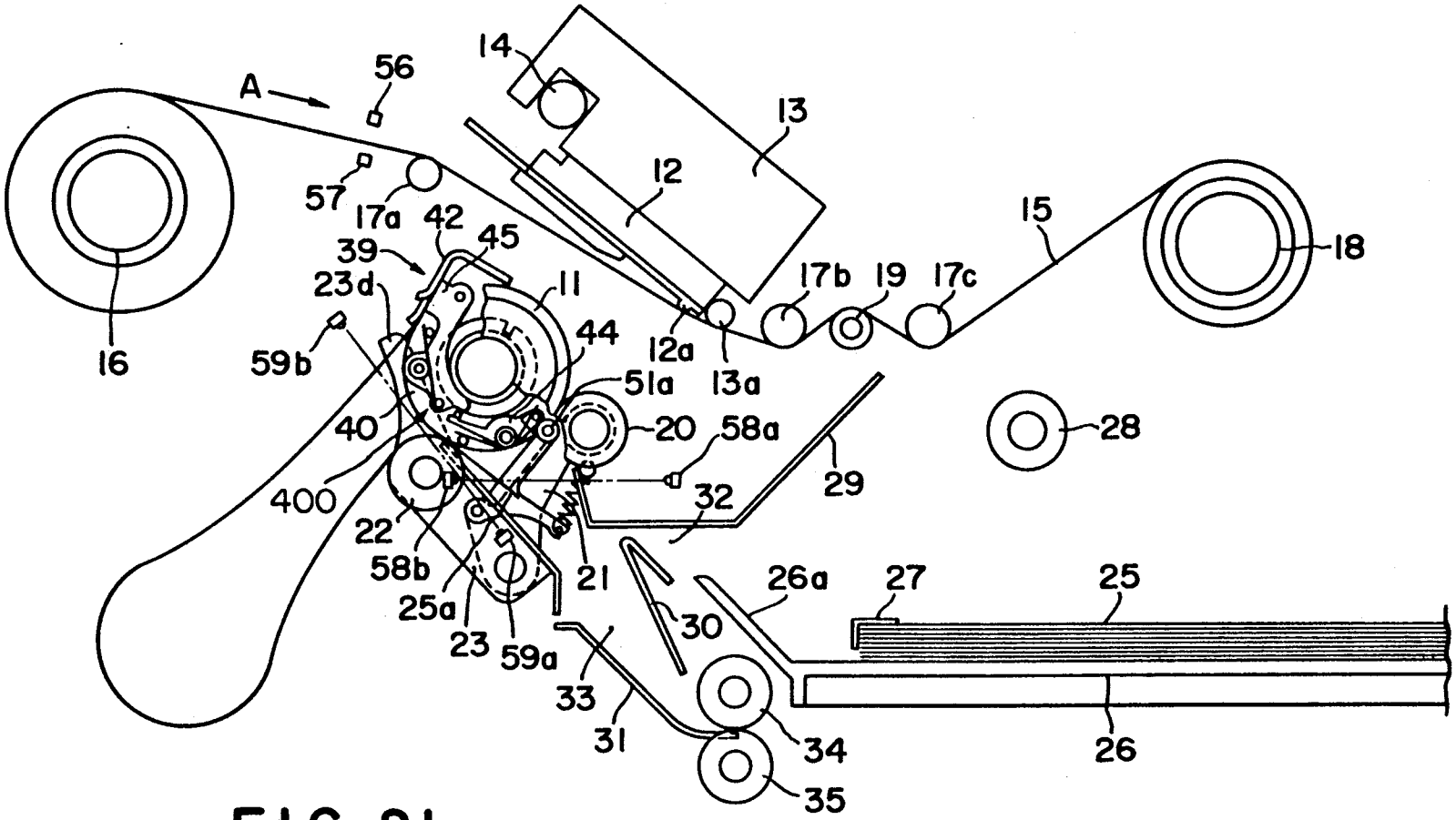
Figure 22:
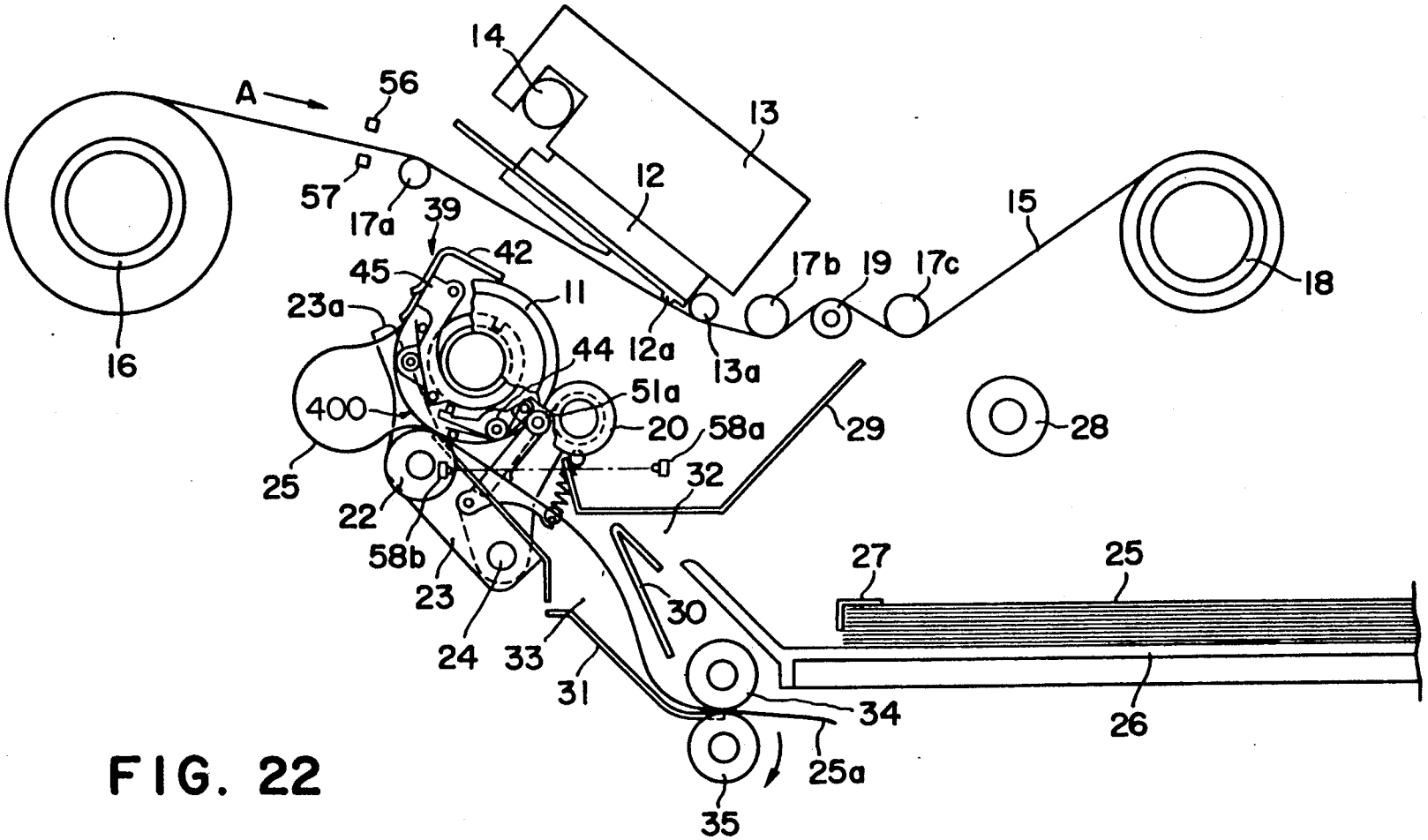

As the first paper sensor 58 stops outputting the detection signal "k3", the signal "h8" is generated to cause the platen roller 11 to rotate in the counterclockwise direction. By the counter-rotation of the platen roller 11, the other end **25*a* of the printing paper, as shown in FIG. 21, is conveyed in the direction of the paper ejecting path 33 which is formed between the guide plates 30 and 31. Furthermore, as the paper 25 is moved to the right as shown in FIG. 22, the other end 25*a* of the paper 25 is inserted between the paper ejection rollers 34 and 35**.

Figure 23:
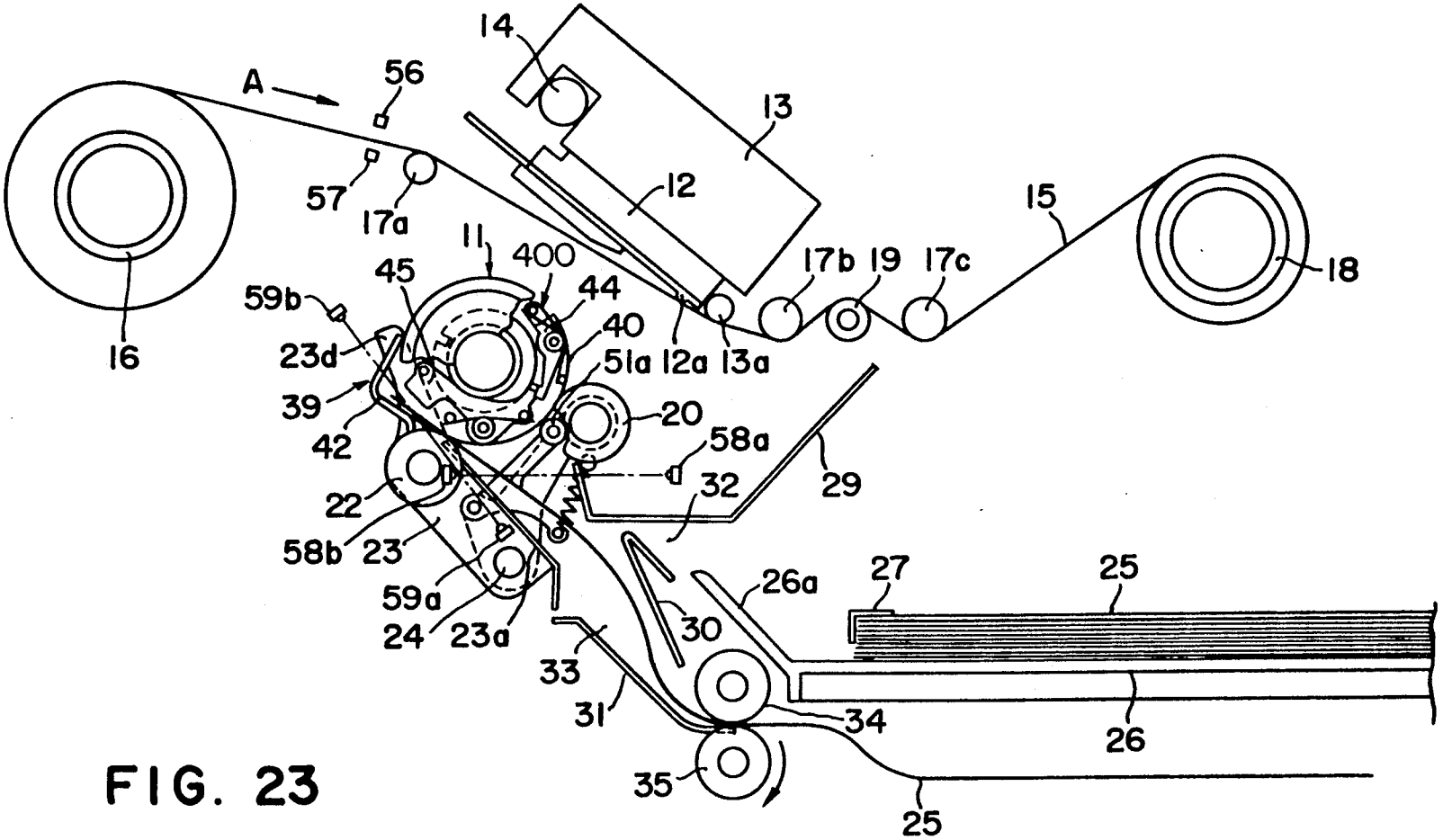

As the paper ejection roller 35 is driven clockwise by the waveform "d8" shown in FIG. 10(*d*) upon the signal outputted from the first paper sensor 58, the paper 25 is drawn out under the paper tray 26 while being held between the paper ejecting rollers 34 and 35 during rotation, as shown in FIG. 23.

During the ejection of the paper 25 by the rollers 34 and 35, the droop of the paper 25 around the platen roller 11 is absorbed, and then the clamp mechanism 39 holding the supplied end of the paper 25 rotates counterclockwise by being drawn by the paper 25, and thereby releases the clamping state by the contact of the pin **45*b* of the clamp lever 45 with the extended portion 23*d* of the guide arm 23**.

When the supplied end of the paper 25 passes through the emission element **59*a* and the receiving element 59*b* of the second paper sensor 59, the second paper sensor 59 detects the passage of the supplied end of the paper 25, and outputs the detection signal "l2" shown in FIG. 10**(*l*). After the second sensor 59 outputs the signal, the paper ejecting rollers 34 and 35 maintain a rotation for a predetermined interval such as two and a half seconds, whereby the printing paper 25 is completely ejected from the printer.

Then, as the pinch roller 20 and the guide roller 22 separate from the platen roller 11 rotating clockwise in FIG. 23, 375 consecutive pulses are counted after the detection of two reference pulses. After that, the series of operations is over by the return of the printer to the standby state.

Figure 29:
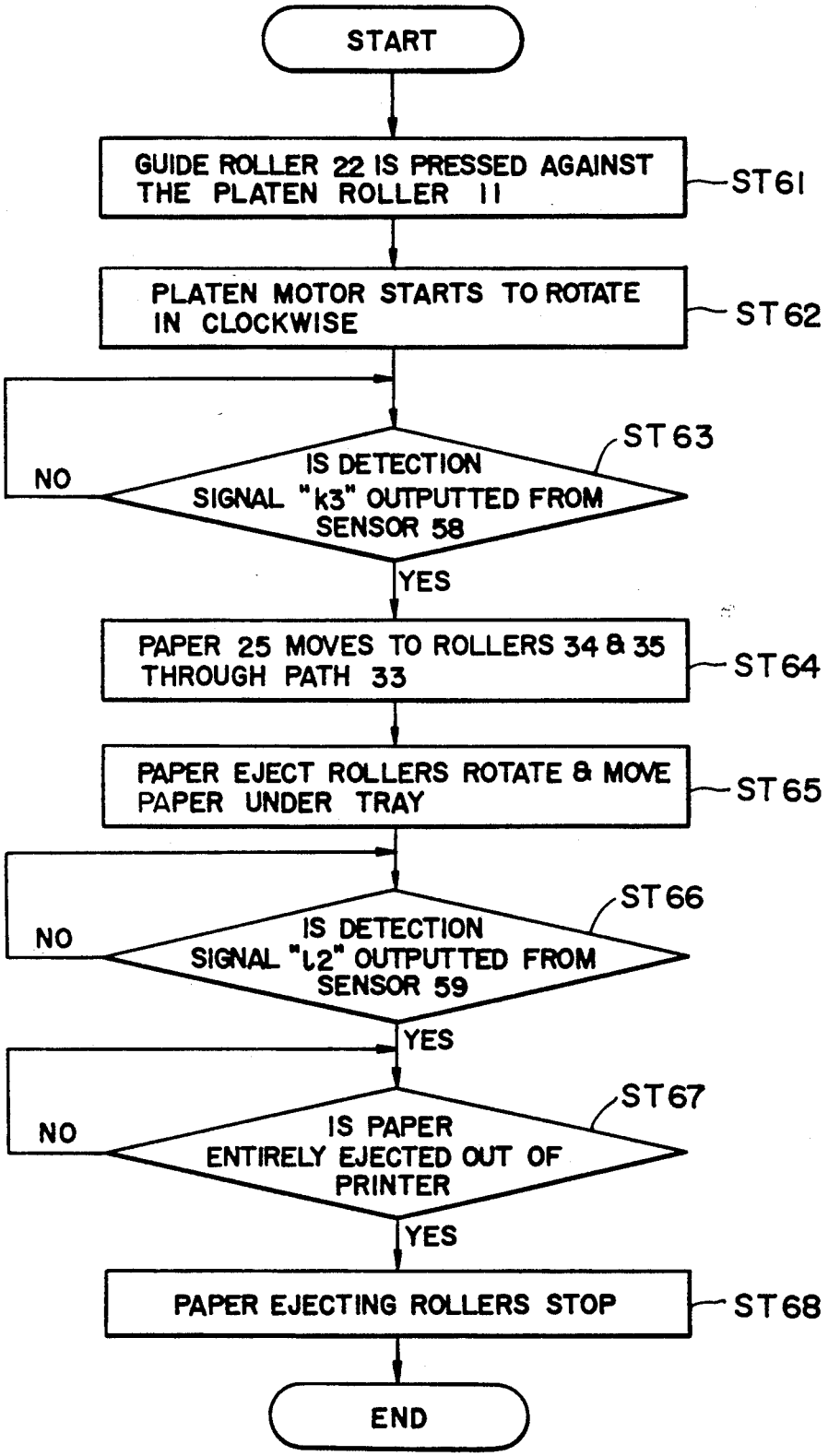
FIG. 29 is a flow chart of a paper ejecting mode, showing the movement of the printer in one embodiment of this invention.

These operations of the paper ejecting mode will be described with reference to the flow chart shown in FIG. 29.

At first, the guide roller 22 is pressed against the platen roller 11 by the clockwise rotation of the guide arm 23 in step ST61. In step ST62, the platen roller 11 starts to rotate clockwise. In step ST63, after the other end of the paper 25 passes through the pinch roller 20, the controller 105 determines whether or not the first paper sensor 58 outputs the paper detection signal "k3" shown in FIG. 10(*k*). If the signal "k3" is outputted, the printing paper 25 is conveyed to the paper ejecting rollers 34 and 35 through the paper ejecting path 33 in step ST64. In step ST65, the paper ejecting rollers 34 and 35 start to rotate by the paper supply and ejecting motor and move the paper 25 under the paper tray 26.

At this time, in step ST66, the controller 105 determines whether or not the second paper sensor 59 outputs the paper detection signal "l2" shown in FIG. 10(*l*). If the second paper sensor 59 outputs the signal "l2", the controller 105 determines whether or not the printing paper 25 has been entirely ejected from the printer, as shown in step ST67. If the paper 25 is entirely ejected, the paper ejecting rollers 34 and 35 stop as indicated in step ST68.

And then, the operation causes the printer in standby to resume the reset mode for the next printing.

In the above-mentioned embodiment, as the first and second paper sensors 58 and 59 are provided over the guide arm 23, the sensors 58 and 59 are capable of detecting the passage of the paper 25 only in the state where the guide roller 22 is pressed against the platen roller 11, otherwise the guide arm 23 may interrupt the sensors 58 and 59. However, the printer of this embodiment is so designed that the sensors 58 and 59 are controlled to be activated when the paper 25 is conveyed for ejection with the press by the guide roller 22.

Though the first and second paper sensors are separately provided for the printer of the above embodiment and perform detecting for feeding and ejecting the paper in particular, this invention is not limited to this embodiment, and only one sensor may be provided to detect both the paper feed and ejection.

Furthermore, in the above embodiment, there is omitted the description of the driving source for rotating the holding member 13, guide arm 23 and lever 50 and so on. Many actuators such as motors, which are individually provided for each rotating member, may drive respectively each member. A motor or motors with a cam or cams attached to its output shaft/shafts, makes it possible to drive each member by the motor or motors through the cam or cams.

As described in detail, the thermal ink-transfer printer of this invention is holding the supplied end of the printing paper supplied to the platen roller by the clamp mechanism until the paper is ejected after the printing is fully completed; therefore, in the case of the color printing with multiple colors to one sheet of paper, there is no chance of color misregistration, and it is possible to repeatedly print by inks of various colors for the image.

Furthermore, the platen roller as the rotation of is allowed for the printing paper the thermal head with the clamp mechanism release the clutch mechanism, it is possible to print a paper longer than the circumference of the platen roller by slackening the printed portion of the paper around the platen roller.

Furthermore, as the platen roller has a small diameter because of the incorporation of the clutch controlled clamp mechanism, the entire construction of the printer can be miniaturized, and it is possible to keep the pressure of the thermal head against the printing paper at a low level.

As the clamp mechanism is not an integral part of the platen roller itself, it is possible to form the platen roller as a simple cylinder, making it possible to precisely finish the shape of the platen roller, to produce the effect of preventing paper slippage during printing.

We claim:

1. A thermal ink-transfer printer for printing a color image on a printing paper wound along an outer surface of a platen roller by pressing a thermal head against the paper and an ink film interposed therebetween and by melting an ink on the ink film caused by the thermal head, said paper being moved by rotation of the platen roller, said printer comprising:

driving means for causing controlled rotation of the platen roller;

clamp means provided rotatably at both ends of said platen roller for clamping and holding an end of the paper fed to the outer surface of said platen roller, said clamp means being rotatable independently from the platen roller and comprising supporting rings rotatably provided at both ends of a shaft of said platen roller for supporting a holding member parallel to said platen roller along a longitudinal direction, and clamp levers mounted respectively on inner surfaces of both said supporting rings for clamping corners of said end of the paper in conjunction with said holding member;

clutch means for coupling and decoupling said clamp means to and from said platen roller so that said clamp means rotate together with said platen roller when coupled thereto by said clutch means, said clutch means comprising clutch levers arranged respectively at inner surfaces of said supporting rings and arranged to engage with said clamp levers for causing said clamp levers to separate from said holding member, and clutch rings mounted on both ends of the shaft of the platen roller between the platen and inner sides of the clamp and clutch levers for rotation with said platen, each of said clutch rings having a recess with which a projection provided on each of said clutch levers engages;

a pinch roller for pressing the paper against said platen roller, when the paper is clamped by said clamp means and is moved by said platen roller in a printing mode;

encoder means mounted on said platen roller for generating a control signal for controlling a print starting time for each color; and control means for controlling said clutch means to couple said platen roller to said clamp means so that said platen roller and said clamp means holding the end of the paper rotate together for a predetermined angular range thereof and to decouple said platen roller from said clamp means to allow said platen roller to rotate beyond said predetermined angular range independent from the clamp means so that the paper continues to move for full printing range thereof in the printing mode, for controlling operations of said pinch roller and said driving means and for controlling said print starting timing for each color on the basis of said control signal from said encoder means.

2. A thermal ink-transfer printer as claimed in claim 1 and further comprising:

a guide roller for pressing said paper against said platen roller in a paper feeding mode for feeding the paper in a direction toward said clamp means when said clutch means decouples said clamp means from the platen roller and in a paper ejecting mode for ejecting said paper after printing in a direction opposite to said feeding direction, the position of said guide roller being controlled by said controlling means.

3. A thermal ink-transfer printer for printing a color image on a printing paper wound along an outer surface of a platen roller having a shaft by pressing a thermal head against the paper and an ink film interposed therebetween and by melting an ink on the ink film by the thermal head, said paper being moved by rotation of the platen roller, comprising:

driving means for causing controlled rotation of the platen roller;

clamp means provided rotatably at both ends of the platen roller for clamping and holding an end of the paper fed to the outer surface of the platen roller, and comprising supporting rings rotatably provided at both ends of the shaft of the platen roller for supporting a holding member parallel to the platen roller along a longitudinal direction, and clamp levers respectively mounted on inner surfaces of both of said supporting rings for clamping corners of an end of the paper in conjunction with the holding member, said clamp means being rotatable independently from said platen roller;

clutch means for coupling and decoupling said clamp means to and from said platen roller so that said clamp means rotate together with said platen roller when coupled thereto by said clutch means, and comprising clutch levers respectively arranged at inner surfaces of said supporting rings and arranged to engage with said clamp levers for causing said clamp levers to separate from said holding member, and clutch rings mounted to both ends of the platen roller shaft and between the platen and inner sides of the clamp and clutch levers for rotation with said platen, each of said clutch rings having a recess with which a projection provided on each of said clutch levers engages;

a pinch roller for pressing the paper against said platen roller, when the paper is clamped by said clamp means and is moved by said platen roller in a printing mode; and means for controlling said clutch means to couple said platen roller to said clamp means so that said platen roller and said clamp means holding the end of the paper rotate together for a predetermined angular range thereof, and to decouple said platen roller from said clamp means to allow said platen roller to rotate beyond said predetermined angular range independent from the clamp means so that the paper continues to move for full printing range thereof in the printing mode and for controlling operation of said pinch roller and said driving means.

4. A thermal ink-transfer printer as claimed in claim 3 and further comprising:

a guide roller for pressing said paper against said platen roller in a paper feeding mode for feeding the paper in a direction toward said clamp means when said clutch means decouples said clamp means from the platen roller and in a paper ejecting mode for ejecting said paper after printing in a direction opposite to said feeding direction, the position of said guide roller being controlled by said controlling means.

5. A thermal ink-transfer printer for printing a color image on a printing paper wound along an outer surface of a platen roller having a shaft by pressing a thermal head against the paper and an ink film interposed therebetween and by melting an ink on the ink film by the thermal head, said paper being moved by rotation of the platen roller, comprising:

driving means for causing controlled rotation of the platen roller;

clamp means provided rotatably at both ends of the platen roller for clamping and holding an end of the paper fed to the outer surface of the platen roller;

clutch means for coupling and decoupling said clamp means to and from said platen roller so that said clamp means rotate together with said platen roller when coupled thereto by said clutch means;

a pinch roller for pressing the paper against said platen roller when the paper is clamped by said clamp means and is moved by said platen roller in a printing mode;

means for controlling said clutch means to couple said platen roller to said clamp means so that said platen roller and said clamp means holding the end of the paper rotate together for a predetermined angular range thereof, and to decouple said platen roller from said clamp means to allow said platen roller to rotate beyond said predetermined angular range independent from the clamp means so that the paper continues to move for full printing range thereof in the printing mode, and for controlling operation of said pinch roller and said driving means; and wherein said clamp means comprises supporting rings rotatably supported on both ends of the shaft of said platen roller, said supporting rings further supporting a clamp lever of said clamp means and said clutch means, said supporting rings respectively further supporting a corner of a holding member, said holding member comprising a long plate having an L-shaped cross-section, and having a recess on an outer surface thereof with which fastening pins provided on a clutch lever of said clutch means respectively engage, said clamp lever of said clamp means clamping and holding a corner of the end of said paper between said clamp lever and said holding member.

6. A thermal ink-transfer printer as claimed in claim 5 and further comprising:

a guide roller for pressing said paper against said platen roller in a paper feeding mode for feeding the paper in a direction toward said clamp means when said clutch means decouples said clamp means from the platen roller and in a paper ejecting mode for ejecting said paper after printing in a direction opposite to said feeding direction, the position of said guide roller being controlled by said controlling means.

7. A thermal ink-transfer printer for printing a color image on a printing paper wound along an outer surface of a platen roller by pressing a thermal head against the paper and an ink film interposed therebetween and by melting an ink on the ink film caused by the thermal head, said paper being moved by rotation of the platen roller, said printer comprising:

driving means for causing controlled rotation of the platen roller;

clamp means provided rotatably at both ends of said platen roller for clamping and holding an end of the paper fed to the outer surface of said platen roller, said clamp means being rotatable independently from the platen roller and comprising supporting rings rotatably supported on both ends of a shaft of said platen roller and further supporting on the inner sides thereof respectively a clamp lever of said clamp means and a clutch lever of said clutch means, said supporting rings further supporting a holding member at respective corners of the holding member, the holding member comprising an elongated plate having an L-shaped cross-section, and each supporting ring having a recess on an outer surface thereof with which fastening pins provided on each clutch lever of said clutch means respectively engage, each clamp lever of said clamping means clamping and holding a corner of the end of said paper between said clamp lever and said holding member;

clutch means for coupling and decoupling said clamp means to and from said platen roller so that said clamp means rotate together with said platen roller when coupled thereto by said clutch means;

a pinch roller for pressing the paper against said platen roller, when the paper is clamped by said clamp means and is moved by said platen roller in a printing mode;

encoder means mounted on said platen roller for generating a control signal for controlling a print starting time for each color; and control means for controlling said clutch means to couple said platen roller to said clamp means so that said platen roller and said clamp means holding the end of the paper rotate together for a predetermined angular range thereof and to decouple said platen roller from said clamp means to allow said platen roller to rotate beyond said predetermined angular range independent from the clamp means so that the paper continues to move for full printing range thereof in the printing mode, for controlling operations of said pinch roller and said driving means and for controlling said print starting timing for each color on the basis of said control signal from said encoder means.

* * * * *